US011430368B2

(12) United States Patent
Oh et al.

(10) Patent No.: US 11,430,368 B2
(45) Date of Patent: Aug. 30, 2022

(54) DATA DRIVING DEVICE AND DISPLAY DEVICE USING THE SAME

(71) Applicant: LG Display Co., Ltd., Seoul (KR)

(72) Inventors: Dae Seok Oh, Paju-si (KR); Yong Won Jo, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/405,701

(22) Filed: Aug. 18, 2021

(65) Prior Publication Data

US 2022/0068184 A1 Mar. 3, 2022

(30) Foreign Application Priority Data

Sep. 1, 2020 (KR) ..... 10-2020-0111213

(51) Int. Cl.
*G09G 3/00* (2006.01)
*G09G 3/20* (2006.01)
*G09G 3/3291* (2016.01)

(52) U.S. Cl.
CPC ..... *G09G 3/2003* (2013.01); *G09G 3/3291* (2013.01); *G09G 2310/027* (2013.01); *G09G 2310/0297* (2013.01); *G09G 2320/0666* (2013.01); *G09G 2320/0673* (2013.01)

(58) Field of Classification Search
None
See application file for complete search history.

(56) References Cited

U.S. PATENT DOCUMENTS 10,515,604 B2 12/2019 Chung et al.
2009/0066681 A1* 3/2009 Kim ..... G09G 3/3685 341/145
2017/0046993 A1* 2/2017 Chang ..... G09G 3/2003
2018/0096666 A1 4/2018 Chung et al.
2018/0182279 A1* 6/2018 Sakariya ..... G09G 3/2022
2019/0340996 A1 11/2019 Kim et al.

FOREIGN PATENT DOCUMENTS

KR 10-2018-0036892 A 4/2018
KR 10-2019-0127095 A 11/2019

* cited by examiner

*Primary Examiner* — Michael A Faragalla
(74) *Attorney, Agent, or Firm* — Fenwick & West LLP

(57) ABSTRACT

Disclosed herein are a data driving device and a display device using the same. The data driving device includes a selector for sequentially selecting pieces of gamma reference data input from banks in the order of a first color, a second color, and a third color, and a voltage output part for converting the pieces of gamma reference data for each color, which is sequentially input, into gamma reference voltages.

14 Claims, 26 Drawing Sheets

DATA DRIVING DEVICE AND DISPLAY DEVICE USING THE SAME

CROSS-REFERENCE TO RELATED APPLICATION

This application claims priority to and the benefit of Republic of Korea Patent Application No. 10-2020-0111213, filed on Sep. 1, 2020, the disclosure of which is hereby incorporated by reference in its entirety.

BACKGROUND

1. Technical Field

The present disclosure relates to a data driving device, which outputs a data voltage optimized for each color, and a display device using the same.

2. Discussion of Related Art

As flat panel display devices, liquid crystal display (LCD) devices, electroluminescent display devices, field emission display (FED) devices, and plasma display panel (PDP) devices are known.

Electroluminescent display devices are roughly classified into inorganic light-emitting display devices and organic light-emitting display devices according to materials of light-emitting layers. Active matrix type organic light emitting display devices include organic light-emitting diodes (hereinafter referred to as "OLEDs"), which emit light by themselves and have advantages in that response speeds are fast and light emission efficiencies, brightness, and viewing angles are high. In the organic light-emitting display devices, an OLED is formed in each pixel. Since the organic light-emitting display devices have fast response speeds and are high in light emission efficiency, brightness, and viewing angle as well as being able to exhibit a black gradation in a full black color, the organic light-emitting display devices are excellent in a contrast ratio and color reproducibility.

SUMMARY

Efficiency may be varied for each color in pixels of a display device. In consideration of the above description, a data driving device of the display device may output a data voltage optimized for each color using an independent gamma compensation voltage for each color. In this case, circuit components may be added for each channel of the data driving device so that a cost of the data driving device may be increased.

An object of the present disclosure is to solve the above-mentioned needs and/or problems.

The present disclosure is directed to providing a data driving device, which allows a circuit configuration for outputting an independent gamma compensation voltage for each color to be simplified and allows a cost to be reduced, and a display device using the same.

It should be noted that objects of the present disclosure are not limited to the above-described objects, and other objects of the present disclosure will be apparent to those skilled in the art from the following descriptions.

According to an aspect of the present disclosure, there is provided a data driving device including a first bank which outputs gamma reference data of a first color, a second bank which outputs gamma reference data of a second color, a third bank which outputs gamma reference data of a third color, a selector configured to sequentially select the pieces of gamma reference data from the first to third banks in an order of the first color, the second color, and the third color, a voltage output part configured to convert the gamma reference data input from the selector into gamma reference voltages, a voltage divider circuit configured to divide the gamma reference voltages for each color sequentially input from the voltage output part and output gamma compensation voltages for each color, a plurality of digital-to-analog converters configured to convert pixel data of the first color into the gamma compensation voltage of the first color, which is input from the voltage divider circuit, to output a data voltage of the first color, converting pixel data of the second color into the gamma compensation voltage of the second color, which is input from the voltage divider circuit, to output data voltage of the second color, and then convert pixel data of the third color into the gamma compensation voltage of the third color, which is input from the voltage divider circuit, to output a data voltage of the third color.

According to another aspect of the present disclosure, there is provided a data driving device including a first gamma reference voltage generator which includes a first bank that outputs gamma reference data of a first color, a second bank that outputs gamma reference data of a second color, and a selector configured to alternately select and convert the pieces of gamma reference data of the first and second colors into gamma reference voltages to alternately output the gamma reference voltages for each color; a second gamma reference voltage generator which includes a third bank that outputs gamma reference data of a third color and converts the gamma reference data of the third color into a gamma reference voltage to output the gamma reference voltage of the third color; a first voltage divider circuit configured to divide the gamma reference voltages of the first and second colors input from the first gamma reference voltage generator to alternately output the gamma compensation voltages of the first and second colors; a second voltage divider circuit configured to divide the gamma reference voltage of the third color input from the second gamma reference voltage generator to alternately output the gamma compensation voltage of the third color; a first digital-to-analog converter configured to convert the pixel data of the first color into a gamma compensation voltage of the first color input from the first voltage divider circuit to output a data voltage of the first color and configured to convert pixel data of the second color into a gamma compensation voltage of the second color input from the first voltage divider circuit to output a data voltage of the second color; and a second digital-to-analog converter configured to convert pixel data of the third color into a gamma compensation voltage of the third color input from the second voltage divider circuit to output a data voltage of the third color.

According to still another aspect of the present disclosure, there is provided a display device including a display panel in which data lines connected to sub-pixels of a first color, data lines connected to sub-pixels of a second color, data lines connected to sub-pixels of a third color, and a plurality of demultiplexers configured to distribute an input data voltage to the data lines are disposed; a plurality of digital-to-analog converters configured to convert pixel data into a data voltage as a gamma compensation voltage for each color; and a data driver including buffers configured to output the data voltage to the demultiplexers.

BRIEF DESCRIPTION OF THE DRAWINGS

The above and other objects, features and advantages of the present disclosure will become more apparent to those skilled in the art by describing exemplary embodiments thereof in detail with reference to the accompanying drawings, in which.

DETAILED DESCRIPTION

Figure 1:
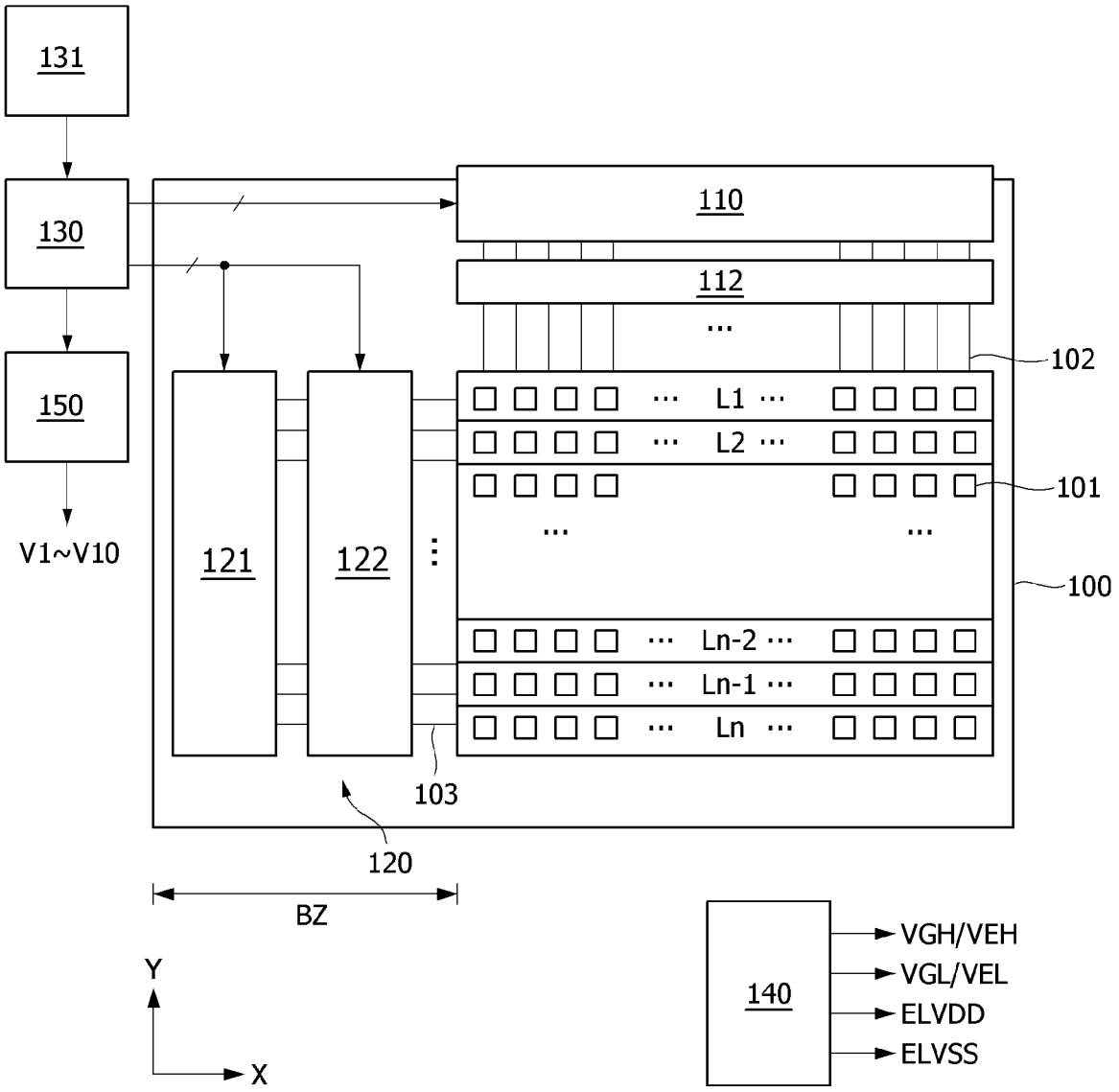
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having," and "comprising" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

In a display device of the present disclosure, a pixel circuit may include at least one of an n-channel transistor and a p-channel transistor. Transistors may be implemented as oxide thin film transistors (oxide TFTs) including an oxide semiconductor, low temperature polysilicon (LTPS) TFTs including low temperature polysilicon, or the like. Further, each of the transistors may be implemented as a p-channel TFT or a n-channel TFT. In embodiments, descriptions will be given based on an example in which the transistors of the pixel circuit are implemented as the p-channel TFTs, but the present disclosure is not limited thereto.

A transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. The n-channel transistor has a direction of a current flowing from the drain to the source. In the case of a p-channel transistor (p-channel metal-oxide semiconductor (PMOS)), since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor. A transistor is turned on in response to a gate-on voltage and is turned off in response to a gate-off voltage. In the case of an n-channel transistor, a gate-on voltage may be a gate high voltage VGH and VEH, and a gate-off voltage may be a gate low voltage VGL and VEL. In the case of a p-channel transistor, a gate-on voltage may be the gate low voltage VGL and VEL, and a gate-off voltage may be the gate high voltage VGH and VEH.

Hereinafter, various embodiments of the present disclosure will be described in detail with reference to the accompanying drawings. In the following embodiments, a display device is mainly described to focus on an organic light-emitting display device, but the present disclosure is not limited thereto.

Referring to FIG. 1, a display device according to an embodiment of the present disclosure includes a display panel 100, a display panel driver for writing pixel data in pixels of the display panel 100, and a power supply 140 for generating power required for driving the pixels and the display panel driver.

The display panel 100 includes a pixel array which displays an input image on a screen. The pixel array includes a plurality of data lines 102, a plurality of gate lines 103 intersecting the data lines 102, and pixels 101 disposed in the form of a matrix. The display panel 100 may further include a power line commonly connected to the pixels 101.

The pixel array includes a plurality of pixel lines L1 to Ln. Each of the pixel lines L1 to Ln includes pixels disposed in one line in a line direction X in the pixel array of the display panel 100. The pixels 101 disposed in one pixel line share the gate lines 103. Sub-pixels disposed in a column direction Y from the data line direction share the same data line 102. One horizontal period 1H is a time obtained by dividing one frame period by the total number of the pixel lines L1 to Ln.

The display panel 100 may be implemented as a non-transmissive display panel or a transmissive display panel. The transmissive display panel may be applied to a transparent display device in which an image is displayed on a screen and a real object of the background is visible. The display panel may be manufactured as a flexible display panel. The flexible display panel may be implemented as an organic light-emitting diode (OLED) panel using a plastic substrate.

In order to implement a color, each of the pixels 101 may be divided into a red sub-pixel, a green sub-pixel, and a blue sub-pixel. Each of the pixels 101 may further include a white sub-pixel. Each of the sub-pixels includes a pixel circuit. Hereinafter, the pixel may be construed as having the same meaning as the sub-pixel.

Figure 2:
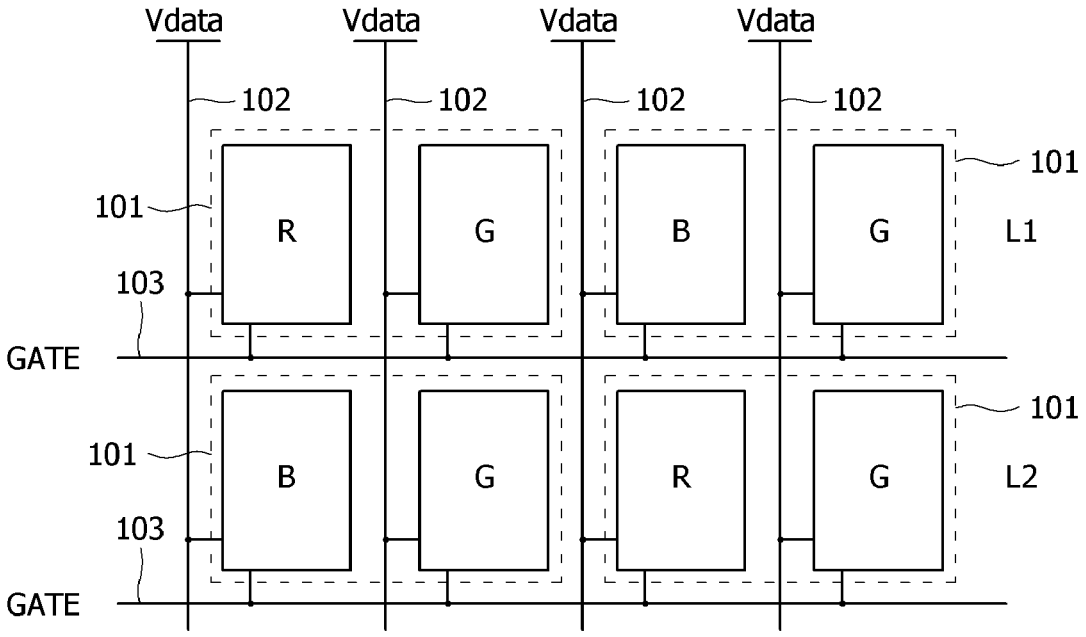
FIGS. 2 and 3 are diagrams illustrating various examples of a color arrangement of sub-pixels according to an embodiment of the present disclosure.
Figure 3:
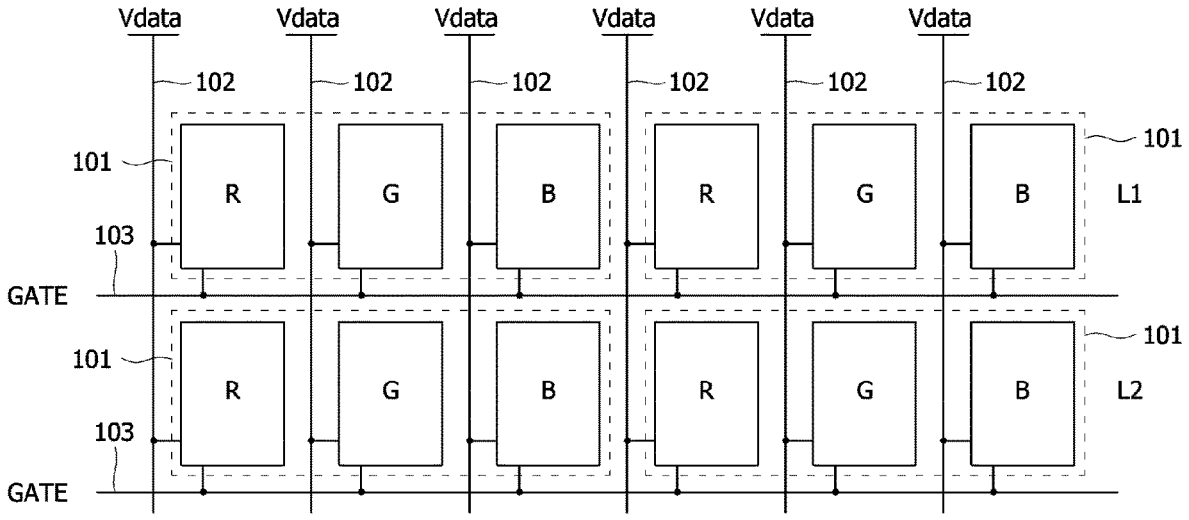

The pixels 101 may have a color arrangement shown in FIGS. 2 and 3. The pixels 101 shown in FIG. 2 may each include two sub-pixels having different colors. As shown in FIG. 2, a pixel rendering algorithm may compensate for insufficient color expression in each of the pixels 101 with a color of light emitted from adjacent pixels. A real color pixel 101 shown in FIG. 3 includes three primary color sub-pixels of red, green, and blue. In FIGS. 2 and 3, Vdata is a data voltage applied to the data lines 102, and GATE is a gate signal applied to the gate lines 103.

Touch sensors may be disposed on the display panel 100. A touch input may be detected using separate touch sensors or may be detected through pixels. The touch sensors may be implemented as an on-cell type or an add-on type, which is disposed on a screen of a display panel, or in-cell type touch sensors which are embedded in a pixel array.

The power supply 140 generates direct current (DC) power required for driving the pixel array of the display panel 100 and a display panel driver using a DC-DC converter. The DC-DC converter may include a charge pump, a regulator, a buck converter, and a boost converter. The power supply 140 may receive a DC input voltage applied from a host system (not shown) and generate DC voltages including gate-on voltages VGL and VEL, gate-off voltages VGH and VEH, a pixel driving voltage ELVDD, a low potential power voltage ELVSS, and reference and initialization voltages Vref and Vini. The gate-on voltages VGL and VEL and the gate-off voltages VGH and VEH are supplied to a level shifter (not shown) and a gate driver 120. The pixel driving voltage ELVDD, the low potential power voltage ELVSS, and the reference and initialization voltages Vref and Vini are commonly supplied to the pixels 101.

The display panel driver writes pixel data of an input image in the pixels 101 of the display panel 100 under the control of a timing controller (TCON) 130. The display panel driver includes a data driver 110 and the gate driver 120. The display panel driver may further include a demultiplexer array 112 disposed between the data driver 110 and the data lines 102.

The demultiplexer array 112 distributes data voltages output from channels of the data driver 110 to the data lines 102 using a plurality of demultiplexers. The demultiplexer array 112 may time-divide and distribute a data voltage output from one channel of the data driver 110 to the data lines 102, thereby reducing the number of channels of the data driver 110.

The display panel driver may further include a touch sensor driver for driving the touch sensors. The touch sensor driver is omitted from FIG. 1. The data driver 110 and the touch sensor driver may be integrated into one drive IC. In mobile devices or wearable devices, the TCON 130, the power supply 140, and the data driver 110 may be integrated into one drive IC.

The data driver 110 converts pixel data of an input image received as a digital signal from the TCON 130 in each frame period into a gamma compensation voltage using a digital-to-analog converter (hereinafter referred to as a "DAC"), thereby generating a data voltage. The data driver 110 receives gamma reference voltages V1 to V10, divides the gamma reference voltages V1 to V10 into gamma compensation voltages for gradations through a voltage divider circuit, and inputs the gamma compensation voltages to the DAC. The gamma compensation voltage for each gradation is provided to the DAC of the data driver 110. The data voltage is output through an output buffer in each channel of the data driver 110.

The gate driver 120 may be implemented as a gate in panel (GIP) circuit which is directly formed on the display panel 100 together with a thin film transistor (TFT) array and lines of the pixel array. The GIP circuit may be disposed on a bezel (BZ) area which is a non-display area of the display panel 100 or distributed and disposed in the pixel array on which an input image is reproduced. The gate driver 120 sequentially outputs gate signals to the gate lines 103 under the control of the TCON 130. The gate driver 120 may shift the gate signal using a shift register, thereby sequentially supplying the shifted gate signals to the gate lines 103. The gate signal may include a scan signal and a light emission control signal (hereinafter referred to as an "EM signal") in the organic light-emitting display device. The scan signal includes a scan pulse which swings between the gate-on voltage VGL and the gate-off voltage VGH. The EM signal may include an EM pulse which swings between the gate-on voltage VEL and the gate-off voltage VEH.

The scan pulse is synchronized with the data voltage to select pixels of a line in which data is to be written. The EM signal defines a light emission time of the pixel.

The gate driver 120 may include a first gate driver 121 and a second gate driver 122. The first gate driver 121 outputs a scan pulse in response to a start pulse and a shift clock from the TCON 130 and shifts the scan pulse according to a shift clock timing. The second gate driver 122 outputs an EM pulse in response to the start pulse and the shift clock from the TCON 130 and sequentially shifts the EM pulse according to the shift clock.

The TCON 130 receives digital video data DATA of an input image and a timing signal synchronized therewith from the host system. The timing signal may include a vertical synchronization signal Vsync, a horizontal synchronization signal Hsync, a clock CLK, and a data enable signal DE. Since a vertical period and a horizontal period may be obtained through a method of counting the data enable signal DE, the vertical synchronization signal Vsync and the horizontal synchronization signal Hsync may be omitted. The data enable signal DE has one horizontal period 1H.

The host system may be any one among a television (TV) system, a set-top box, a navigation system, a personal computer (PC), a home theater system, a mobile device, a wearable device, and a vehicle system.

The TCON 130 may multiply an input frame frequency i times to control an operation timing of the display panel driver at a frame frequency of an input frame frequency×i Hz (i is a positive integer greater than zero). The input frame frequency is 60 Hz in a national television system committee (NTSC) method and is 50 Hz in a phase-alternating line (PAL) method. In order to lower a refresh rate of pixels in a low speed driving mode, the TCON 130 may lower a frame frequency to a frequency between 1 Hz and 30 Hz, thereby lowering a driving frequency of the display panel driver.

The TCON 130 generates a data timing control signal for controlling an operation timing of the data driver 110, MUX signals MUX1 and MUX2 for controlling an operation timing of the demultiplexer array 112, and a gate timing control signal for controlling an operation timing of the gate driver 120 on the basis of the timing signals Vsync, Hsync, and DE which are received from the host system. The TCON 130 controls the operation timing of the display panel driver to synchronize the data driver 110, the demultiplexer array 112, the touch sensor driver, and the gate driver 120.

An electrically erasable and programmable read-only memory (EEPROM) 131 may be connected to the TCON 130. The EEPROM 131 stores input and output timing control values of circuits constituting the display panel driver. The TCON 130 generates timing control signals for controlling the display panel drivers on the basis of the timing control values stored in the EEPROM 131. In mobile devices, the EEPROM 131 may be replaced with a flash memory.

A voltage level of the gate timing control signal output from the TCON 130 may be converted into the gate-on voltage VGL or VEL and the gate-off voltage VGH or VEH through the level shifter (not shown) to be supplied to the gate driver 120. The level shifter converts a low level voltage of the gate timing control signal to a gate low voltage VGL and converts a high level voltage of the gate timing control signal to a gate high voltage VGH. The gate timing signal includes a start pulse and a shift clock.

The display panel driver further includes a gamma reference voltage generator 150. The gamma reference voltage generator 150 generates gamma reference voltages V1 to V10 for colors of the sub-pixels. The TCON 130 may generate an enable signal for selecting the gamma reference voltages V1 to V10 for each color and controls the gamma reference voltage generator 150. The gamma reference voltage generator 150 may be implemented as a programmable gamma IC (P-GMA IC).

Figure 4:
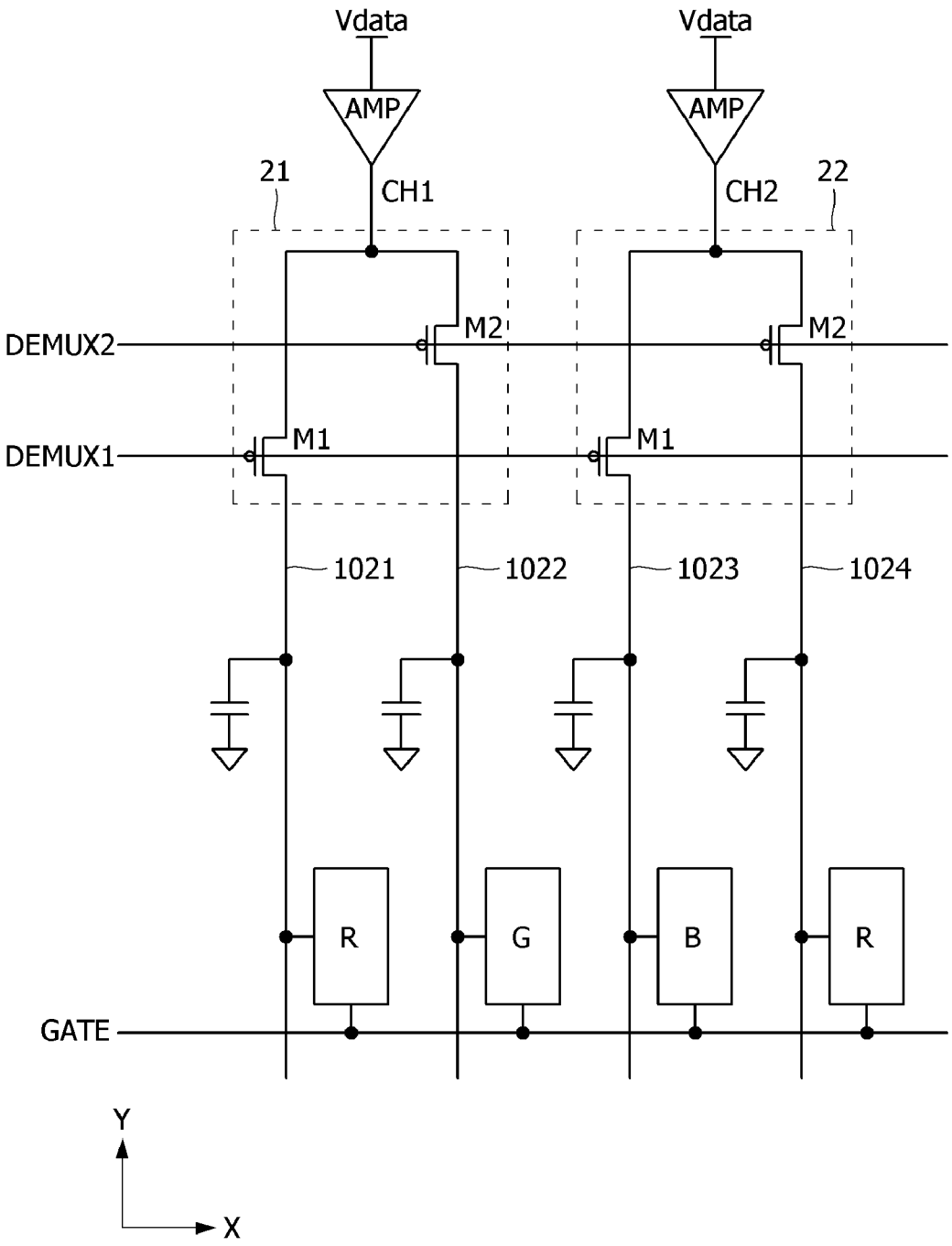
FIG. 4 is a circuit diagram illustrating switching elements of a demultiplexer according to an embodiment of the present disclosure.

FIG. 4 is a circuit diagram illustrating switching elements of a demultiplexer according to one embodiment.

Referring to FIG. 4, each of demultiplexers 21 and 22 may be a 1:N demultiplexer having one input node and N output nodes (N is a positive integer greater than or equal to two). The demultiplexers 21 and 22 may each include first and second switching elements M1 and M2.

The first switching element M1 is turned on in response to a gate-on voltage VGL of a first DEMUX signal DEMUX1. In this case, a first channel CH1 of the data driver 110 outputs a data voltage Vdata through an output buffer AMP, and the data voltage Vdata is applied to a first data line 1021 through the first switching element M1. Simultaneously, a second channel CH2 of the data driver 110 outputs a data voltage Vdata through an output buffer AMP, and the data voltage Vdata is applied to a third data line 1023 through the first switching element M1. Thus, during a ½ horizontal period, the data voltage Vdata is charged in capacitors of the first and third data lines 1021 and 1023.

Subsequently, the second switching elements M2 are turned on in response to a gate-on voltage VGL of a second DEMUX signal DEMUX2. In this case, the first channel CH1 of the data driver 110 outputs a data voltage Vdata through the output buffer AMP, and the data voltage Vdata is applied to a second data line 1022 through the second switching element M2. Simultaneously, the second channel CH2 of the data driver 110 outputs a data voltage Vdata through the output buffer AMP, and the data voltage Vdata is applied to a fourth data line 1024 through the second switching element M2. Thus, during a ½ horizontal period, the data voltage Vdata is charged in capacitors of the second and fourth data lines 1022 and 1024.

Figure 5:
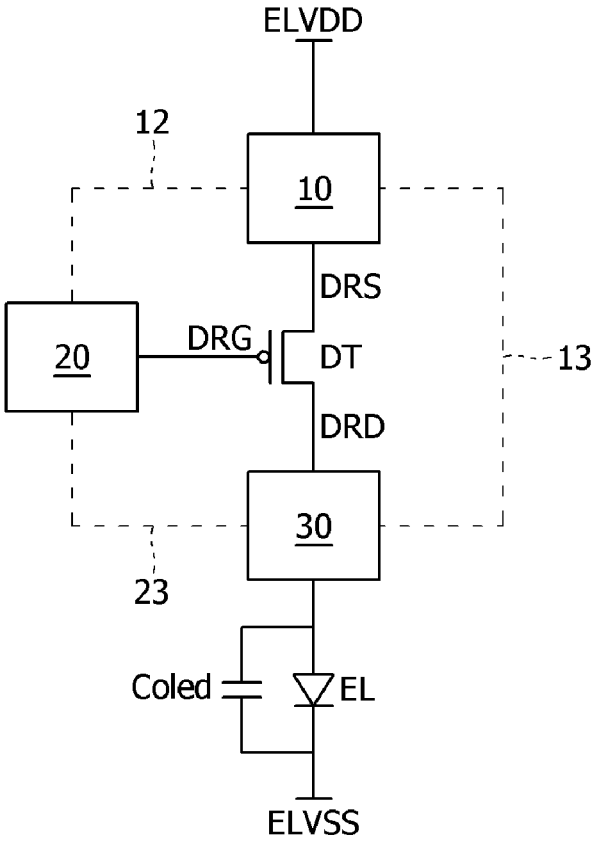
FIG. 5 is a schematic diagram illustrating a pixel circuit according to an embodiment of the present disclosure.

FIG. 5 is a schematic diagram illustrating a pixel circuit of the present disclosure.

Referring to FIG. 5, the pixel circuit includes a light-emitting element EL, a driving element DT, and first to third circuits 10, 20, and 30. Each of switching elements of the driving element DT and the first to third circuits 10, 20, and 30 may be implemented as a transistor.

The first circuit 10 supplies a pixel driving voltage ELVDD to the driving element DT. The driving element DT includes a gate DRG, a source DRS, and a drain DRD. The second circuit 20 charges a capacitor connected to the gate DRG of the driving element DT and maintains a voltage of the capacitor during one frame period. The third circuit 30 provides the light-emitting element EL with a current supplied from the pixel driving voltage ELVDD through the driving element DT. A first connector 12 connects the first circuit 10 to the second circuit 20. A second connector 23 connects the second circuit 20 to the third circuit 30. A third connector 13 connects the third circuit 30 to the first circuit 10.

Each of the first to third circuits 10, 20, and 30 may include an internal compensation circuit and/or an external compensation circuit. The internal compensation circuit may be disposed in each of the pixel circuits of the sub-pixels and may sample a gate-source voltage Vgs of the driving element DT, which is varied according to an electrical characteristic of the driving element DT, and compensate for a gate voltage of the driving element DT by as much as the gate-source voltage Vgs. The external compensation circuit may detect electrical characteristics of the driving element DT and the light-emitting element EL in real time and modulate pixel data by reflecting the detected result to the pixel data of an input image, thereby compensating for a variation in electrical characteristic of each of the sub-pixels or deviation in electrical characteristic between the sub-pixels in real time.

Figure 6:
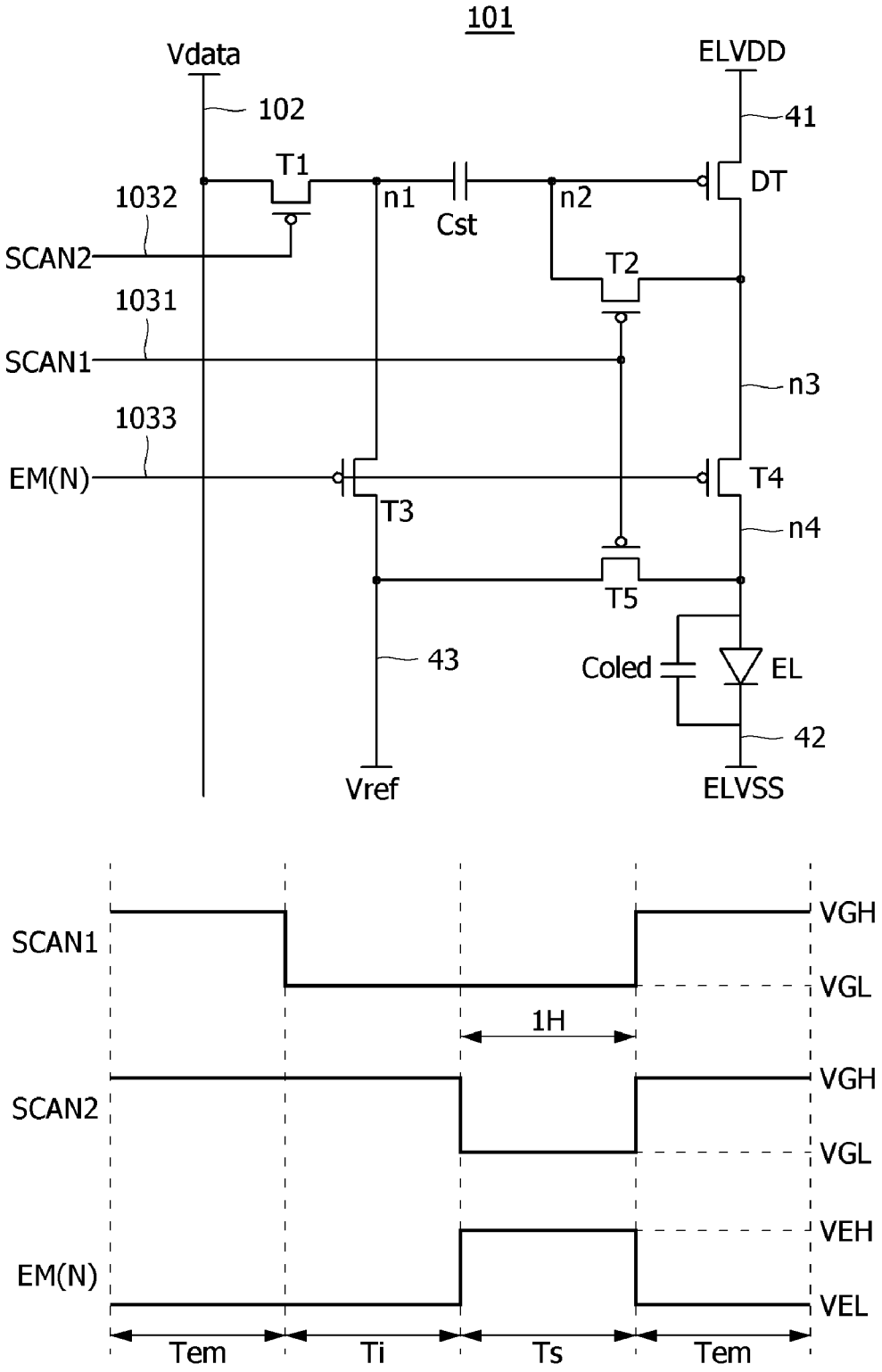
FIGS. 6 and 7 are diagrams illustrating pixel circuits to which an internal compensation circuit is applied according to an embodiment of the present disclosure.
Figure 7:
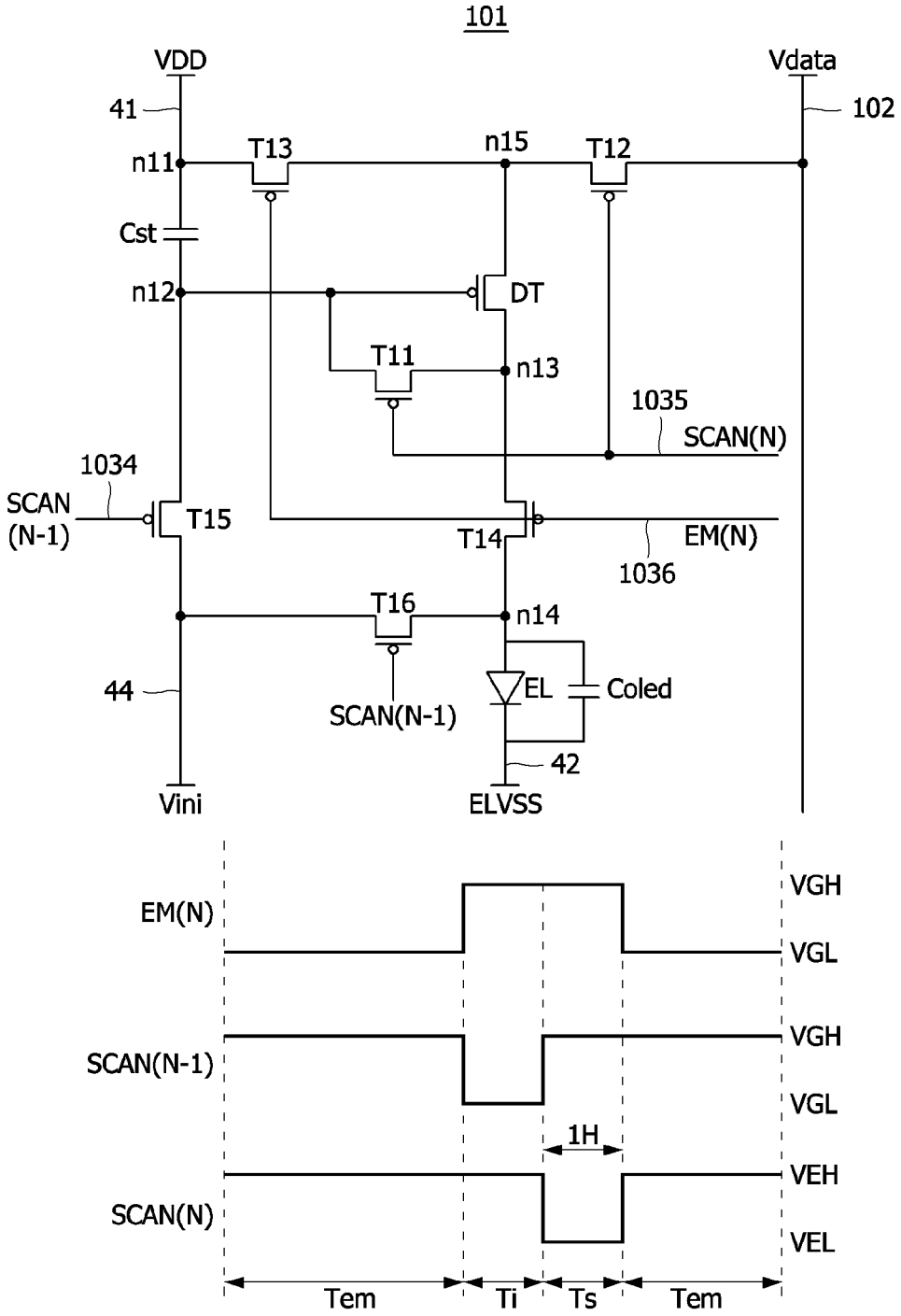

FIGS. 6 and 7 are diagrams illustrating pixel circuits to which an internal compensation circuit is applied. In FIGS. 6 and 7, the display panel 100 may include a first power line 41 which supplies the pixel driving voltage ELVDD to the pixels 101, a second power line 42 which supplies the low potential power voltage ELVSS to the pixels 101, and third power lines 43 and 44 which supply the pixels 101 with reference and initialization voltages Vref and Vini for initializing the pixel circuits. The power lines commonly apply the DC voltage output from the power supply 140 to the pixels 101.

The light-emitting element EL may be implemented as an OLED. The OLED includes an organic compound layer formed between an anode and a cathode. The organic compound layer may include a hole injection layer HIL, a hole transport layer HTL, a light emission layer EML, an electron transport layer ETL, and an electron injection layer EIL, but the present disclosure is not limited thereto. When a voltage is applied to the anode and the cathode of the OLED, holes passing through the hole transport layer HTL and electrons passing through the electron transport layer ETL move to the light emission layer EML to form excitons so that visible light is emitted from the light emission layer EML.

In FIGS. 6 and 7, the driving element DT and the switching elements may be implemented as p-channel transistors.

Referring to FIG. 6, the anode of the light-emitting element EL is connected to fourth and fifth switching elements T4 and T5 through a fourth node n4. The cathode of the light-emitting element EL is connected to the second power line 42 to which the low potential power voltage ELVSS is applied. The driving element DT controls an amount of a current flowing to the light-emitting element EL according to the gate-source voltage Vgs, thereby driving the light-emitting element EL. The current flowing to the light-emitting element EL may be switched by the fourth switching element T4. A capacitor Cst is connected between a first node n1 and a second node n2.

In response to a second scan signal SCAN2, a first switching element T1 supplies the data voltage Vdata to the first node n1. The first switching element T1 includes a gate connected to a second gate line 1032, a first electrode connected to the data line 102, and a second electrode connected to the first node n1.

The second scan signal SCAN2 is supplied to the pixels 101 through the second gate line 1032. The second scan signal SCAN2 is generated as a pulse of the gate-on voltage VGL. The pulse of the second scan signal SCAN2 defines a sensing operation Ts. A pulse width of the second scan signal SCAN2 may be approximately set to one horizontal period 1H. The second scan signal SCAN2 is changed to the gate-on voltage VGL later than a first scan signal SCAN1 and is simultaneously changed to the gate-off voltage VGH as the first scan signal SCAN1. The pulse width of the second scan signal SCAN2 is set to be smaller than (e.g., less than) a pulse width of the first scan signal SCAN1. During an initialization operation Ti and a light emission operation Tem, a voltage of the second scan signal SCAN2 is maintained at the gate-off voltage VGH.

In response to the first scan signal SCAN1, a second switching element T2 connects a gate of the driving element DT to a second electrode thereof, thereby allowing the driving element DT to be operated as a diode. The second switching element T2 includes a gate connected to a first gate line 1031, a first electrode connected to the second node n2, and a second electrode connected to a third node n3.

The first scan signal SCAN1 is supplied to the pixels 101 through the first gate line 1031. The first scan signal SCAN1 may be generated as a pulse of the gate-on voltage VGL. The pulse of the first scan signal SCAN1 defines the initialization operation Ti and the sensing operation Ts. During the light emission operation Tem, a voltage of the first scan signal SCAN1 is maintained at the gate-off voltage VGH.

In response to an EM signal EM(N), a third switching element T3 supplies a predetermined reference voltage Vref to the first node n1. The reference voltage Vref is supplied to the pixels 101 through the third power line 43. The third switching element T3 includes a gate connected to a third gate line 1033, a first electrode connected to the first node n1, and a second electrode connected to the third power line 43. The EM signal EM(N) defines an on/off time of the light-emitting element EL.

During the sensing operation Ts, in order to block a current path between the first node n1 and the third power line 43 and a current path of the light-emitting element EL, a pulse of the EM signal EM(N) may be generated as the gate-off voltage VGH. When the second scan signal SCAN2 is reversed to the gate-on voltage VGL, the EM signal EM(N) may be reversed to the gate-off voltage VGH, and after the first and second scan signals SCAN1 and SCAN2 are reversed to the gate-off voltages VGH, the EM signal EM(N) may be reversed to the gate-on voltage VGL. In order to accurately express a brightness of a low gradation, during the light emission operation Tem, the EM signal EM(N) may swing between the gate-on voltage VGL and the gate-off voltage VGH at a predetermined duty ratio.

In response to the EM signal EM(N), the fourth switching element T4 switches the current path of the light-emitting element EL. A gate of the fourth switching element T4 is connected to the third gate line 1033. A first electrode of the fourth switching element T4 is connected to the third node n3, and a second electrode thereof is connected to the fourth node n4.

The fifth switching element T5 is turned on in response to the gate-on voltage VGL of the first scan signal SCAN1 and supplies the reference voltage Vref to the fourth node n4 during the initialization operation Ti and the sensing operation Ts. During the initialization operation Ti and the sensing operation Ts, an anode voltage of the light-emitting element EL is discharged as the reference voltage Vref. In this case, since a voltage between the anode and the cathode is less than a threshold voltage of the light-emitting element EL, the light-emitting element EL does not emit light. The fifth switching element T5 includes a gate connected to the first gate line 1031, a first electrode connected to the third power line 43, and a second electrode connected to the fourth node n4.

The driving element DT controls a current flowing in the light-emitting element EL according to the gate-source voltage Vgs, thereby driving the light-emitting element EL. The driving element DT includes the gate connected to the second node n2, a first electrode connected to the first power line 41, and a second electrode connected to the third node n3. The pixel driving voltage ELVDD is supplied to the pixels 101 through the first power line 41.

An operation of the pixel circuit shown in FIG. 6 may be divided into the initialization operation Ti, the sensing operation Ts, and the light emission operation Tem.

In the initialization operation Ti, a voltage of each of the first scan signal SCAN1 and the EM signal EM(N) is the gate-on voltage VGL. The second to fifth switching elements T2 to T5 are turned on in the initialization operation Ti so that voltages at the first node n1, the second node n2, and the fourth node n4 are discharged as the reference voltage Vref. Consequently, in the initialization operation Ti, a voltage of the capacitor Cst, the gate voltage of the driving element DT, and the anode voltage of the light-emitting element EL are initialized at the reference voltage Vref.

In the sensing operation Ts, the first, second, and fifth switching elements T1, T2, and T5 are turned on according to the gate-on voltages VGL of the scan signals SCAN1 and SCAN2. In this case, the data voltage Vdata is applied to the first node n1, and the voltage of the second node n2 is changed to a voltage of ELVDD+Vth. Consequently, in the sensing operation Ts, a threshold voltage Vth of the driving element DT is detected, and the second node n2 is charged with the threshold voltage Vth. During the sensing operation Ts, the capacitor Cst is charged with a data voltage Vdata which is compensated for by as much as the threshold voltage Vth of the driving element DT.

In the light emission operation Tem, the voltage of the EM signal EM(N) is reversed to the gate-on voltage VGL. In the light emission operation Tem, the third and fourth switching elements T3 and T4 are turned on. In this case, the voltage of the first node n1 is changed to the reference voltage Vref, and the voltage of the second node n2 is changed to a voltage of Vref−Vdata+ELVDD+Vth. In the light emission operation Tem, the light-emitting element EL is driven by the current provided through the driving element DT to emit light. The current flowing through the light-emitting element EL is adjusted according to the gate-source voltage Vgs of the driving element DT. During the light emission operation Tem, the gate-source voltage Vgs of the driving element DT is a voltage of Vgs=Vref−Vdata+Vth.

Referring to FIG. 7, a gate signal applied to the pixel circuit includes a (N−1)th scan signal SCAN(N−1), an Nth scan signal SCAN(N), and the EM signal EM(N). The (N−1)th scan signal SCAN(N−1) is synchronized with a data voltage Vdata of a (N−1)th pixel line. The Nth scan signal SCAN(N) is synchronized with a data voltage Vdata of an Nth pixel line. A pulse of the Nth scan signal SCAN(N) is generated with the same pulse width as the (N−1)th scan signal SCAN(N−1) and generated later than a pulse of the (N−1)th scan signal SCAN(N−1).

A capacitor Cst is connected between a first node n11 and a second node n12. The pixel driving voltage ELVDD is supplied to the pixel circuit through a first power line 41. The first node n11 is connected to the first power line 41, a first electrode of the third switching element T13, and a first electrode of the capacitor Cst.

The first switching element T11 is turned on in response to the gate-on voltage VGL of the Nth scan pulse SCAN(N) to connect a gate of the driving element DT to a second electrode of the first switching element T11. The first switching element T11 includes a gate connected to a second gate line 1035, a first electrode connected to the second node n12, and the second electrode connected to a third node n13. The Nth scan signal SCAN(N) is supplied to the pixels 101 through the second gate line 1035. The third node n13 is connected to a gate of the driving element DT, the second electrode of the first switching element T11, and a first electrode of a fourth switching element T14.

The second switching element T12 is turned on in response to the gate-on voltage VGL of the $N^{th}$ scan signal SCAN(N) to apply the data voltage Vdata to a first electrode of the driving element DT. The second switching element T12 includes a gate connected to the second gate line 1035, a first electrode connected to a fifth node n15, and a second electrode connected to the data line 102. The fifth node n15 is connected to the first electrode of the driving element DT, the first electrode of the second switching element T12, and a second electrode of the third switching element T13.

In response to the EM signal EM(N), the third switching element T13 supplies the pixel driving voltage ELVDD to the first electrode of the driving element DT. The third switching element T13 includes a gate connected to a third gate line 1036, the first electrode connected to the first power line 41, and the second electrode connected to the fifth node n15. The EM signal EM(N) is supplied to the pixels 101 through the third gate line 1036.

The fourth switching element T14 is turned on in response to the gate-on voltage VGL of the EM signal EM(N) to connect a second electrode of the driving element DT to the anode of the light-emitting element EL. A gate of the fourth switching element T14 is connected to the third gate line 1036. A first electrode of the fourth switching element T14 is connected to the third node n13, and a second electrode thereof is connected to a fourth node n14. The fourth node n14 is connected to the anode of the light-emitting element EL, the second electrode of the fourth switching element T14, and a second electrode of a sixth switching element T16.

A fifth switching element T15 is turned on in response to the gate-on voltage VGL of the $(N-1)^{th}$ scan signal SCAN (N−1) to connect the second node n12 to the third power line 44 and initializes the capacitor Cst and the gate of driving element DT during the initialization operation Ti. The fifth switching element T15 includes a gate connected to the first gate line 1034, a first electrode connected to the second node n12, and a second electrode connected to the third power line 44.

The (N−1)th scan signal SCAN(N−1) is supplied to the pixels 101 through the first gate line 1034. The initialization voltage Vini is supplied to the pixels 101 through the third power line 44.

The sixth switching element T16 is turned on in response to the gate-on voltage VGL of the $(N-1)^{th}$ scan signal SCAN(N−1) to connect the third power line 44 to the anode of the light-emitting element EL during the initialization operation Ti. During the initialization operation Ti, the anode voltage of the light-emitting element EL is discharged as the initialization voltage Vini through the sixth switching element T16. In this case, since a voltage between the anode and the cathode is less than a threshold voltage of the light-emitting element EL, the light-emitting element EL does not emit light. The sixth switching element T16 includes a gate connected to the first gate line 1034, a first electrode connected to the third power line 44, and the second electrode connected to the fourth node n14.

The driving element DT controls a current flowing in the light-emitting element EL according to the gate-source voltage Vgs, thereby driving the light-emitting element EL. The driving element DT includes the gate connected to the second node n12, the first electrode connected to the fifth node n15, and the second electrode connected to the third node n13.

An operation of the pixel circuit shown in FIG. 7 may be divided into an initialization operation Ti, a sensing operation Ts, and a light emission operation Tem.

In the initialization operation Ti, the fourth and fifth switching elements T14 and T15 are turned on in response to the gate-on voltage VGL of the (N−1)th scan signal SCAN(N−1). In this case, the voltages of the second and fourth nodes n12 and n14 are discharged as the initialization voltage Vini. Consequently, in the initialization operation Ti, a voltage of the capacitor Cst, the gate voltage of the driving element DT, and the anode voltage of the light-emitting element EL are initialized at the initialization voltage Vini.

In the sensing operation Ts, the first and second switching elements T11 and T12 are turned on in response to the gate-on voltage VGL of the $N^{th}$ scan signal SCAN(N). In this case, the data voltage Vdata is applied to the fifth node n15, and the voltage of the second node n12 is changed to a voltage of Vdata+Vth. Consequently, in the sensing operation Ts, a threshold voltage Vth of the driving element DT is detected, and the second node n12 is charged with the threshold voltage Vth. During the sensing operation Ts, the capacitor Cst is charged with a data voltage Vdata which is compensated for by as much as the threshold voltage Vth of the driving element DT.

In the light emission operation Tem, the voltage of the EM signal EM(N) is reversed to the gate-on voltage VGL. In the light emission operation Tem, the third and fourth switching elements T13 and T14 are turned on. During the light emission operation Tem, a current flows in the light-emitting element EL through the driving element DT, thereby allowing the light-emitting element EL to emit light. The current flowing through the light-emitting element EL is adjusted according to the gate-source voltage Vgs of the driving element DT. During the light emission operation Tem, the gate-source voltage Vgs of the driving element DT is a voltage of Vgs=Vdata+Vth−ELVDD.

Figure 8:
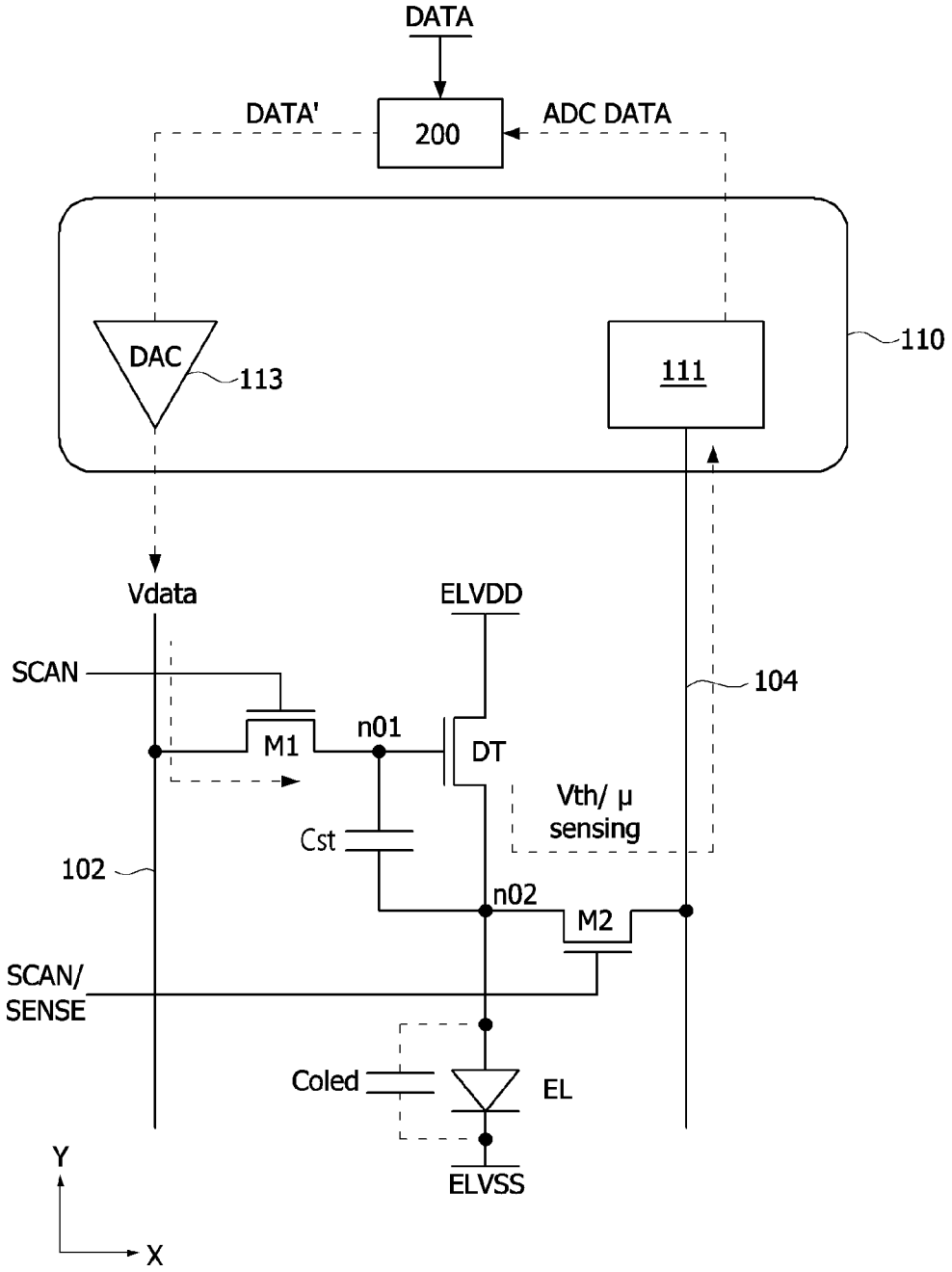
FIG. 8 is a circuit diagram illustrating an example of a pixel circuit to which an external compensation circuit is applied according to an embodiment of the present disclosure.

FIG. 8 is a circuit diagram illustrating an example of a pixel circuit to which an external compensation circuit is applied according to one embodiment.

Referring to FIG. 8, the pixel circuit may include a light-emitting element EL, a driving element DT connected to the light-emitting element EL, a plurality of switching elements M1 and M2, and a capacitor Cst. The driving element DT and the switching elements M1 and M2 may be implemented as n-channel transistors, but the present disclosure is not limited thereto.

The light-emitting element EL emits light using a current generated according to a gate-source voltage Vgs of the driving element DT, which is varied according to a data voltage Vdata. The light-emitting element EL may be implemented as an OLED including an organic compound layer formed between an anode and a cathode. A capacitor "Coled" shows a capacitance of the light-emitting element EL.

A first switching element M1 is turned on in response to a gate-on voltage of a scan signal SCAN to connect a data line 102 to a first node n01, thereby supplying the data voltage Vdata to the first node n01. The first switching element M1 includes a gate electrode to which the scan signal SCAN is applied, a first electrode connected to the data line 102, and a second electrode connected to the first node n01. The first node n01 is connected to a gate of the driving element DT, a first electrode of the capacitor Cst, and the second electrode of the first switching element M1.

A second switching element M2 is turned on in response to a gate-on voltage of the scan signal SCAN or a sensing signal SENSE to supply a predetermined reference voltage to a second node n02. The second switching element M2 includes a gate to which the scan signal SCAN or the sensing signal SENSE is applied, a first electrode connected to the second node n02, and a second electrode connected to a sensing line 104 to which the reference voltage is applied. The second node n02 is connected to a second electrode of the driving element DT, a second electrode of the capacitor Cst, and the first electrode of the second switching element M2.

The driving element DT supplies a current to the light-emitting element EL according to the gate-source voltage Vgs to drive the light-emitting element EL. The driving element DT includes the gate connected to the first node n01, the first electrode to which a pixel driving voltage ELVDD is supplied, and the second electrode connected to the second node n02.

The capacitor Cst is connected between the first node n1 and the second node n2 to maintain the gate-source voltage Vgs of the driving element DT for one frame.

The external compensation circuit may initialize the sensing line 104 and a source voltage of the driving element DT, that is, the voltage of second node n02, at a reference voltage and then detect a current or a voltage of the second node n02, thereby sensing electrical characteristics of the light-emitting element EL and the driving element DT. The electrical characteristics of the light-emitting element EL and the driving element DT may include a threshold voltage Vth and mobility μ.

A sensing part 111 may include an integrator and an ADC. The sensing part 111 inputs a current or a voltage on the sensing line 104, which is connected to the pixel circuit, to the integrator and samples the current or the voltage in a sensing mode. An output voltage of the integrator is input to the ADC and converted into digital data ADC DATA. The digital data ADC DATA output from the ADC includes a sensing value indicating an electrical characteristic of subpixels. The sensing part 111 together with a DAC 113 may be integrated into an IC of a data driver 110.

The TCON 130 may include a compensator 200. The compensator 200 includes a look-up table in which a compensation value for compensating for a threshold voltage Vth and mobility μ of the driving element DT is set for each sub-pixel. The compensator 200 inputs detected data received through the ADC into the look-up table and modulates pixel data by adding a compensation value output from the look-up table to pixel data DATA of an input image or multiplying the pixel data DATA by the compensation value. Compensated data DATA' output from the compensator 200 is transmitted to the data driver 110. The data driver 110 converts the compensated data DATA' input from the compensator 200 into a gamma compensation voltage of the data voltage Vdata through the DAC 113 and outputs the gamma compensation voltage to the data line 102.

Figure 9:
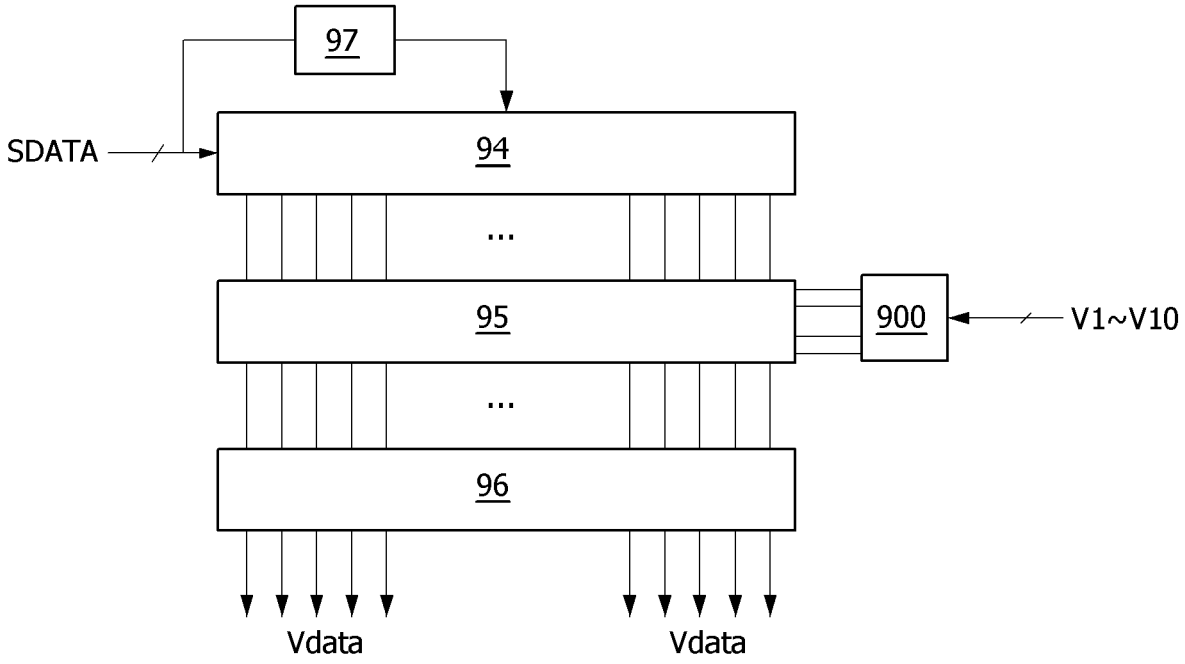
FIG. 9 is a schematic block diagram illustrating a circuit configuration of a data driver according to an embodiment of the present disclosure.

FIG. 9 is a schematic diagram illustrating a circuit configuration of the data driver 110. The data driver 110 may be implemented as one or more drive ICs, each having the circuit configuration shown in FIG. 9.

Referring to FIG. 9, the data driver 110 includes a serial-to-parallel converter 94, a clock recovery part 97, a digital to analog converter (DAC) 95, an output part 96, and a voltage divider circuit 900.

The TCON 130 may transmit serial data SDATA to the data driver 110 as a digital signal of a differential signal. The serial data SDATA may be transmitted to the data driver 110 in the form of a data packet including pixel data of an input image, a clock, and a source output enable signal SOE.

The clock recovery part 97 multiplies the clock received from the TCON 130 using a phase locked loop (PLL) or a delay locked loop (DLL), generates a clock for data sampling, and provides the clock for data sampling to the serial-to-parallel converter 94. The serial-to-parallel converter 94 samples the serial data SDATA received from the TCON 130 according to the clock from the clock recovery part 97 and converts the serial data SDATA into parallel data. The serial-to-parallel converter 94 may include a shift register and a latch. In response to the source output enable signal SOE detected from the serial data SDATA received from the TCON 130, the latch simultaneously outputs data through a plurality of channels to convert serial data into parallel data.

Figure 10:
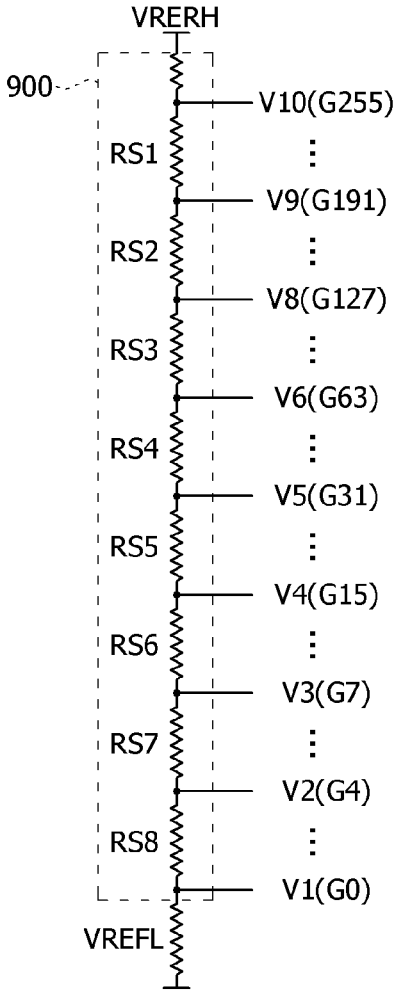
FIG. 10 is a circuit diagram illustrating a voltage divider circuit shown in FIG. 9 according to an embodiment of the present disclosure.
Figure 11:
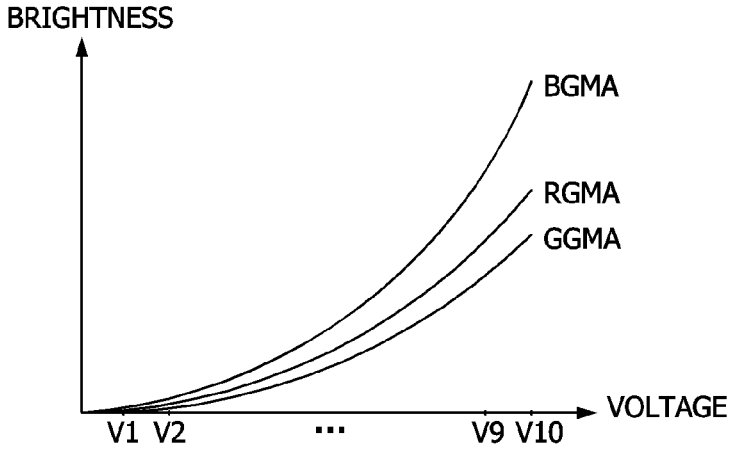
FIG. 11 is a diagram illustrating a gamma curve of each color according to an embodiment of the present disclosure.

The voltage divider circuit 900 divides the gamma reference voltages V1 to V10 using a plurality of resistors connected in series and outputs gamma compensation voltages which are independently set for each color. The gamma compensation voltages output from the voltage divider circuit 900 are voltages which are optimized for each color according to a preset gamma curve for each color. As shown in FIGS. 10 and 11, in order to independently generate the gamma compensation voltages for each color, the gamma reference voltages V1 to V10 in each color may be generated as voltages of ten different voltage levels, but the present disclosure is not limited thereto. For example, the gamma reference voltages V1 to V10 may be generated as gamma reference voltages of m levels (m is a positive integer greater than or equal to six). The gamma reference voltages of m levels may be the gamma reference voltages V1 to V10. Each of the gamma reference voltages V1 to V10 is set as an independent voltage for each color. Accordingly, a gamma reference voltage for each color, which is selected according to a color of the data voltage Vdata applied to the DAC 95, is supplied to the voltage divider circuit 900.

The DAC 95 converts the digital data (pixel data) input from the serial-to-parallel converter 94 into the independent gamma compensation voltage for each color provided from the voltage divider circuit 900 and outputs the data voltage Vdata which is set as a target voltage of each gradation. The data voltage Vdata may be transmitted to the data lines 102 through a demultiplexer array 112 and the output part 96 or may be directly applied to the data lines 102. The output part 96 outputs the data voltage Vdata through an output buffer AMP connected to an output node of the DAC 95 at each channel of the data driver 110.

FIG. 10 is a circuit diagram illustrating the voltage divider circuit 900 shown in FIG. 9 according to one embodiment. FIG. 11 is a diagram illustrating a gamma curve of each color according to one embodiment.

Referring to FIG. 10, the voltage divider circuit 900 includes a plurality of resistors connected in series. The gamma compensation voltage for each gradation defined by the gamma curve is output at a node between the resistors.

The voltage divider circuit 900 may be divided into a plurality of voltage divider circuits RS1 to RS8 connected in series between a high potential reference voltage VREFH and a low potential reference voltage VREFL.

A first voltage divider circuit RS1 divides a tenth gamma reference voltage V10 in the middle of the tenth gamma reference voltage V10 and a ninth gamma reference voltage V9 and outputs a gamma compensation voltage for each gradation between 255 gradation G255 and 191 gradation G191. The tenth gamma reference voltage V10 may be a voltage corresponding to a target voltage of the highest gradation, for example, the 255 gradation G255. The ninth gamma reference voltage V9 may be a voltage corresponding to a target voltage of the 191 gradation G199. A second divider circuit RS2 divides the ninth gamma reference voltage V9 in the middle of the ninth gamma reference voltage V9 and an eighth gamma reference voltage V8 and outputs a gamma compensation voltage for each gradation between the 191 gradation G191 and a 127 gradation G127. The eighth gamma reference voltage V8 may be a voltage corresponding to a target voltage of the 127 gradation G127. A third divider circuit RS3 divides the eighth gamma reference voltage V8 in the middle of the eighth gamma reference voltage V8 and a seventh gamma reference voltage V7 and outputs a gamma compensation voltage for each gradation between the 127 gradation G127 and a 63 gradation G63. The seventh gamma reference voltage V7 may be a voltage corresponding to a target voltage of the 63 gradation G63.

A seventh divider circuit RS7 divides a third gamma reference voltage V3 in the middle of the third gamma reference voltage V3 and a second gamma reference voltage V2 and outputs a gamma compensation voltage for each gradation between a 7 gradation G7 and a 4 gradation G4. An eighth divider circuit RS8 divides the second gamma reference voltage V2 in the middle of the second gamma reference voltage V2 and a first gamma reference voltage V1 and outputs a gamma compensation voltage for each gradation between a 4 gradation G4 and a zero gradation G0.

Since efficiency of the light emission layer EML is different in each color, in order to implement ideal optical compensation, as shown in FIG. 11, the data voltage Vdata should be differently set for each color. In FIG. 11, a horizontal axis is the data voltage Vdata, and a vertical axis is a brightness. In FIG. 11, RGMA is a red gamma curve, GGMA is a green gamma curve, and BGMA is a blue gamma curve.

Figure 12:
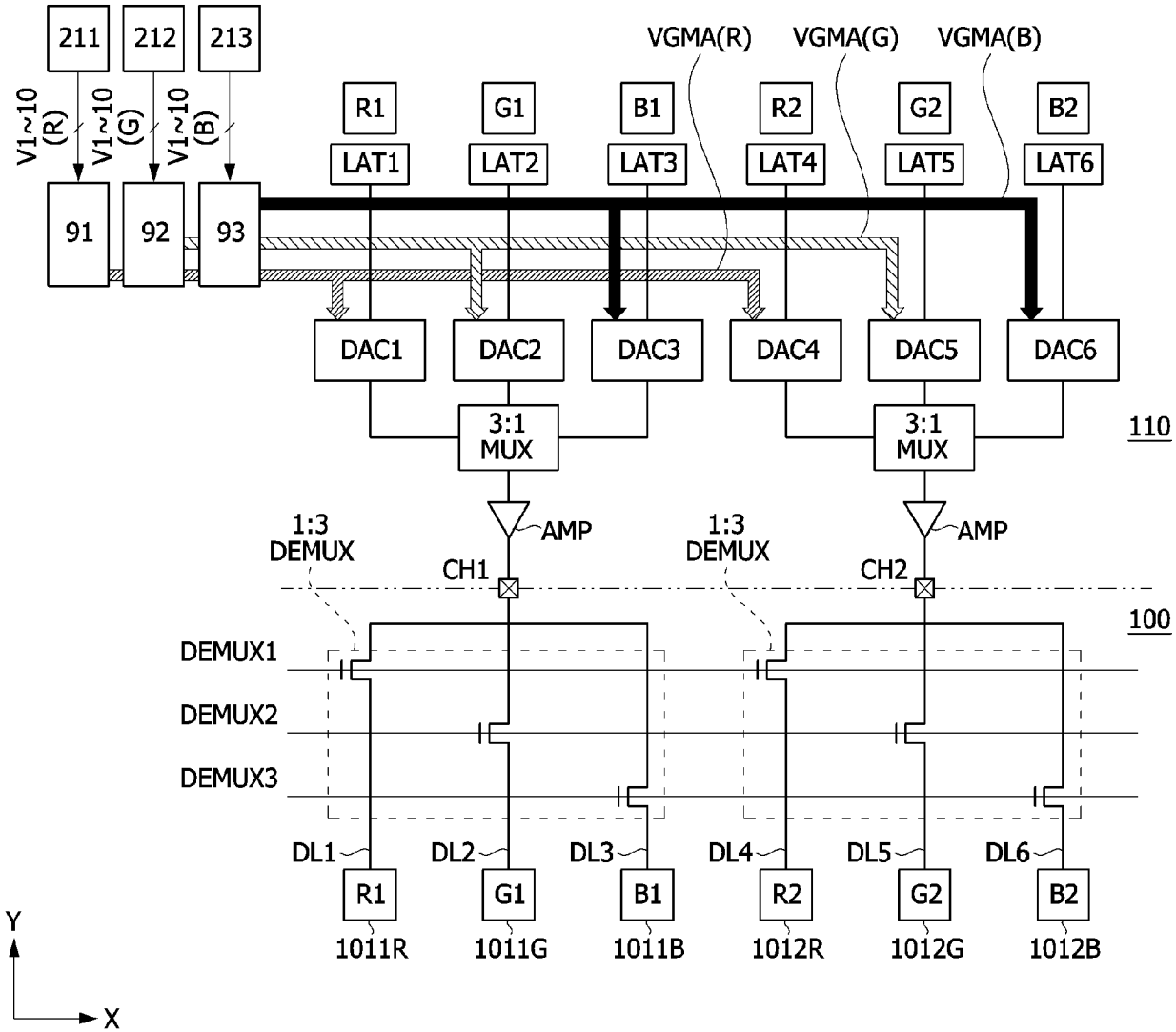
FIGS. 12 and 13 are circuit diagrams illustrating data drivers which output a data voltage using an independent gamma compensation voltage for each color according to an embodiment of the present disclosure.
Figure 13:
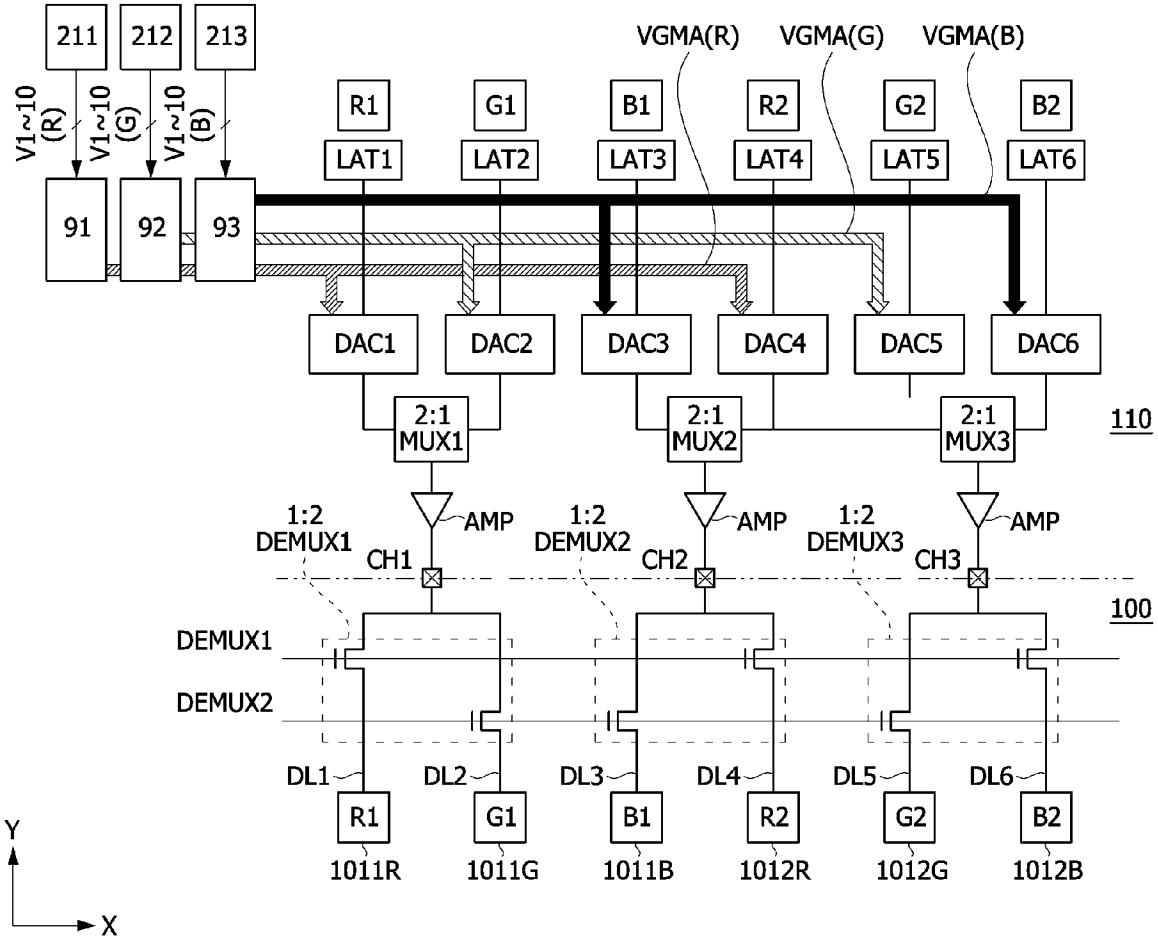

FIGS. 12 and 13 are circuit diagrams illustrating data drivers which output a data voltage using an independent gamma compensation voltage for each color according to one embodiment.

Referring to FIGS. 12 and 13, the demultiplexer 112 may be connected to channels CH1 and CH2 of the data driver 110. The data driver 110 may include a plurality of latches LAT1 to LAT6, a plurality of DACs DAC1 to DAC6, and multiplexers 3:1 MUX and 2:1 MUX which are disposed in the channels CH1 and CH2.

A gamma reference voltage generator may include first to third gamma reference voltage generators 211, 212, and 213 which are separated for each color. A voltage divider circuit may include first to third voltage divider circuits 91, 92, and 93 which are separated for each color.

The first gamma reference voltage generator 211 outputs gamma reference voltages V1(R) to V10(R) of a first color R. The second gamma reference voltage generator 212 outputs gamma reference voltages V1(G) to V10(G) of a second color G. The third gamma reference voltage generator 213 outputs gamma reference voltages V1(B) to V10(B) of a third color B. The first voltage divider circuit 91 divides the gamma reference voltages V1(R) to V10(R) from the first gamma reference voltage generator 211 to output a gamma compensation voltage VGMA(R) of the first color R for each gradation. The second voltage divider circuit 92 divides the gamma reference voltages V1(G) to V10(G) from the second gamma reference voltage generator 212 to output a gamma compensation voltage VGMA(G) of the second color G for each gradation. The third voltage divider circuit 93 divides the gamma reference voltages V1(B) to V10(B) from the third gamma reference voltage generator 213 to output a gamma compensation voltage VGMA(B) of the third color B for each gradation.

The demultiplexer array 112 may include a plurality of 1:3 demultiplexers 1:3 DEMUX shown in FIG. 12 or include a plurality of 1:2 demultiplexers 1:2 DEMUX shown in FIG. 13. The data driver 110 may include the 3:1 multiplexer 3:1 MUX corresponding to the 1:3 demultiplexer 1:3 DEMUX. The data driver 110 may include the 2:1 multiplexer 2:1 MUX corresponding to the 1:2 demultiplexer 1:2 DEMUX.

The first and fourth DACs DAC1 and DAC4 convert pixel data of first colors R1 and R2 into the gamma compensation voltage VGMA(R) from the first voltage divider circuit 91 to output data voltages of the first colors R1 and R2. The second and fifth DACs DAC2 and DAC5 convert pixel data of second colors G1 and G2 into the gamma compensation voltage VGMA(G) from the second voltage divider circuit 92 to output data voltages of the second colors G1 and G2. The third and sixth DACs DAC3 and DAC6 convert pixel data of third colors B1 and B2 into the gamma compensation voltage VGMA(B) from the third voltage divider circuit 93 to output data voltages of the third colors B1 and B2.

In FIG. 12, the 3:1 multiplexers 3:1 MUX sequentially output data voltages in the order of the first colors R1 and R2, the second colors G1 and G2, and the third colors B1 and B2) under the control of the TCON 130.

In response to control signals DEMUX1 to DEMUX3 from the TCON 130, the 1:3 demultiplexers 1:3 DEMUX sequentially output data voltages of the first to third colors in a preset order for one horizontal period 1H. A pulse width of each of the control signals DEMUX1 to DEMUX3 may be approximately set to ⅓ of one horizontal period 1H. The 1:3 demultiplexers 1:3 DEMUX are synchronized with the 3:1 multiplexers 3:1 MUX, supply the data voltages of the first colors R1 and R2 to data lines DL1 and DL4 connected to sub-pixels of the first colors R1 and R2, and then supply the data voltages of the second colors G1 and G2 to data lines DL2 and DL5 connected to sub-pixels of the second colors G1 and G2. Subsequently, the 1:3 demultiplexers 1:3 DEMUX are synchronized with the 3:1 multiplexers 3:1 MUX to supply the data voltages of the third colors B1 and B2 to data lines DL3 and DL6 connected to sub-pixels of the third colors B1 and B2.

In FIG. 13, first 2:1 multiplexers 2:1 MUX1 sequentially output data voltages from the first and second DACs DAC1 and DAC2 in the order of the first color R1 and the second color G1 under the control of the TCON 130. Second 2:1 multiplexers 2:1 MUX2 sequentially output data voltages from the third and fourth DACs DAC3 and DAC4 in the order of the first color R2 and the third color B1 under the control of the TCON 130. Third 2:1 multiplexers 2:1 MUX3 sequentially output data voltages from the fifth and sixth DACs DAC5 and DAC6 in the order of the third color B2 and the second color G2 under the control of the TCON 130.

In response to the control signals DEMUX1 and DEMUX2 from the TCON 130, the 1:2 demultiplexers 1:2 DEMUX1 and 1:2 DEMUX2 sequentially output the data voltages of the first to third colors in a preset order for one horizontal period 1H. A pulse width of each of the control signals DEMUX1 and DEMUX2 may be approximately set to ½ of one horizontal period 1H. The first 1:2 demultiplexer 1:2 DEMUX1 is synchronized with the first 2:1 multiplexer 2:1 MUX1, supplies the data voltage of the first color R1 to the first data line DL1, and then supplies the data voltage of the second color G1 to the second data line DL1. The second 1:2 demultiplexer 1:2 DEMUX2 is synchronized with the second 2:1 multiplexer 2:1 MUX2, supplies the data voltage of the first color R2 to the fourth data line DL4, and then supplies the data voltage of the first color B1 to the third data line DL3. The third 1:2 demultiplexer 1:2 DEMUX3 is synchronized with the third 2:1 multiplexer 2:1 MUX3, supplies the data voltage of the third color B2 to the sixth data line DL6, and then supplies the data voltage of the second color G2 to the fifth data line DL5.

In the data driving devices shown in FIGS. 12 and 13, for independent gamma compensation for each color synchronized with the output timings of the demultiplexers in the display panel 100 including the demultiplexers, the data driver 110 additionally requires three voltage divider circuits, one multiplexer in each channel CH1, CH2, or CH3, and a DAC and a latch for each color. Consequently, a circuit of the data driver becomes larger and a cost thereof is increased.

Figure 14:
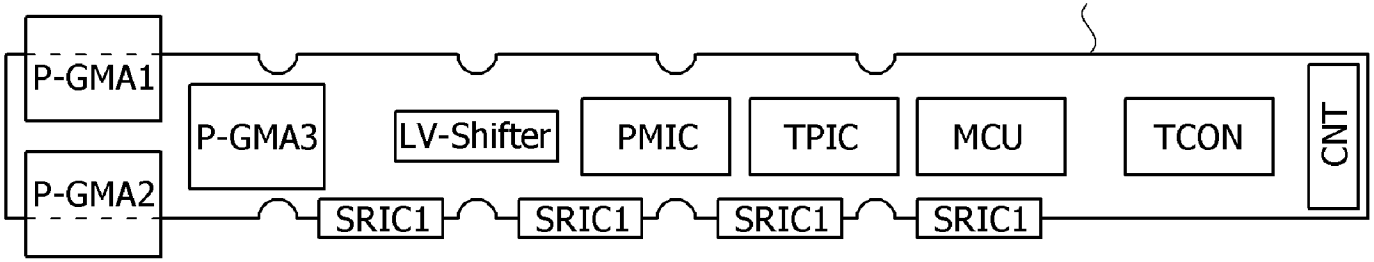
FIG. 14 is a diagram illustrating an example of a display panel driver mounted on a small printed circuit board according to an embodiment of the present disclosure.

Each of the gamma reference voltage generators 211, 212, and 213 may be implemented as a P-GMA IC. In order to implement the data driving device shown in FIGS. 13 and 14, three P-GMA ICs are required. Components of the display panel driver may be mounted on a printed circuit board (PCB) or a chip on film (COF). Due to the mounting area of the three P-GMA ICs, the PCB or COF may become larger. However, there may be a product environment in which a size of the PCB or COF cannot be increased. In this case, as shown in FIG. 14, three P-GMA ICs P-GMA1, P-GMA2, and P-GMA3 cannot be mounted. For example, in a rollable display shown in FIG. 15, since the COF and the PCB are installed in a roller ROL having a small diameter, widths of the COF and the PCB are small. In FIG. 14, a LV-Shifter is an integrated circuit (IC) in which the level shifter is mounted. A PMIC is an IC in which the power supply 140 is mounted. A TPIC is an IC in which circuits for generating the driving signal waveform of a touch sensor are mounted. A micro control unit (MCU) calculates coordinates of a touch input and transmits coordinate data to the host system. An SRIC is an IC in which the data driver 110 and the touch sensor driver are integrated together. A TCON is an IC in which the integrated TCON 130 is formed.

Figure 15:
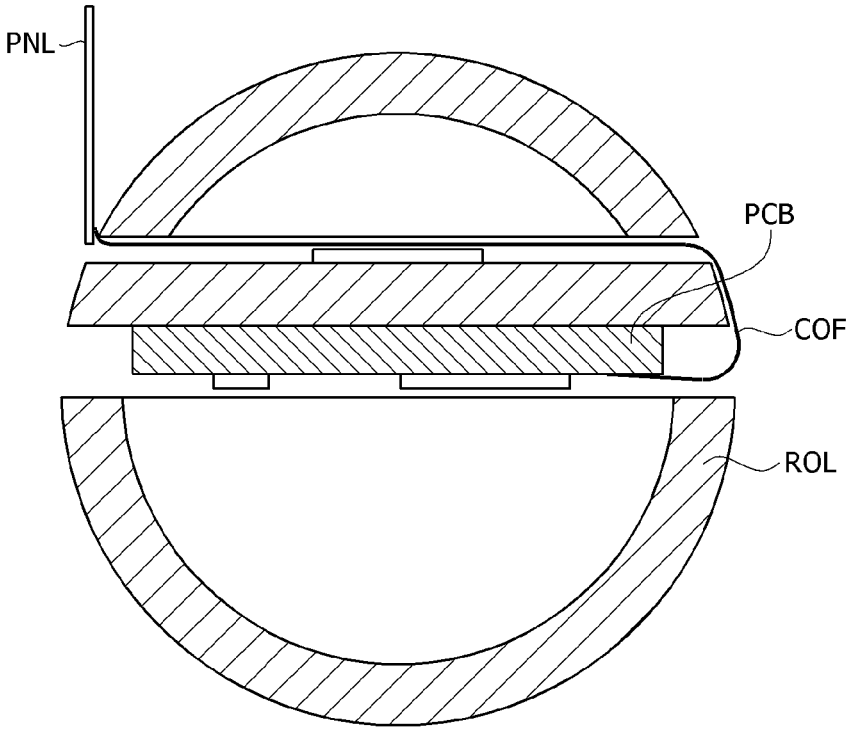
FIG. 15 is a schematic cross-sectional view illustrating a rollable display according to an embodiment of the present disclosure.

In the rollable display shown in FIG. 15, a flexible display panel PNL is wound on a roller ROL which is rotatable due to a driving force of a motor so that a size of a screen may be varied. The COF is connected to the flexible display panel PNL and connected to the PCB through a connector CNT. The COF and the PCB are installed in the roller.

According to the present disclosure, in the data driving device for driving the display panel including the demultiplexer, the gamma reference voltages are sequentially selected for each color so that the circuit configuration of the data driver may be simplified and a cost may be reduced. According to the present disclosure, independent gamma compensation for each color may be implemented such that a single voltage divider circuit is used without distinguishing the voltage divider circuits by color and without separating the DAC and the latch for each channel of the data driver.

Figure 16:
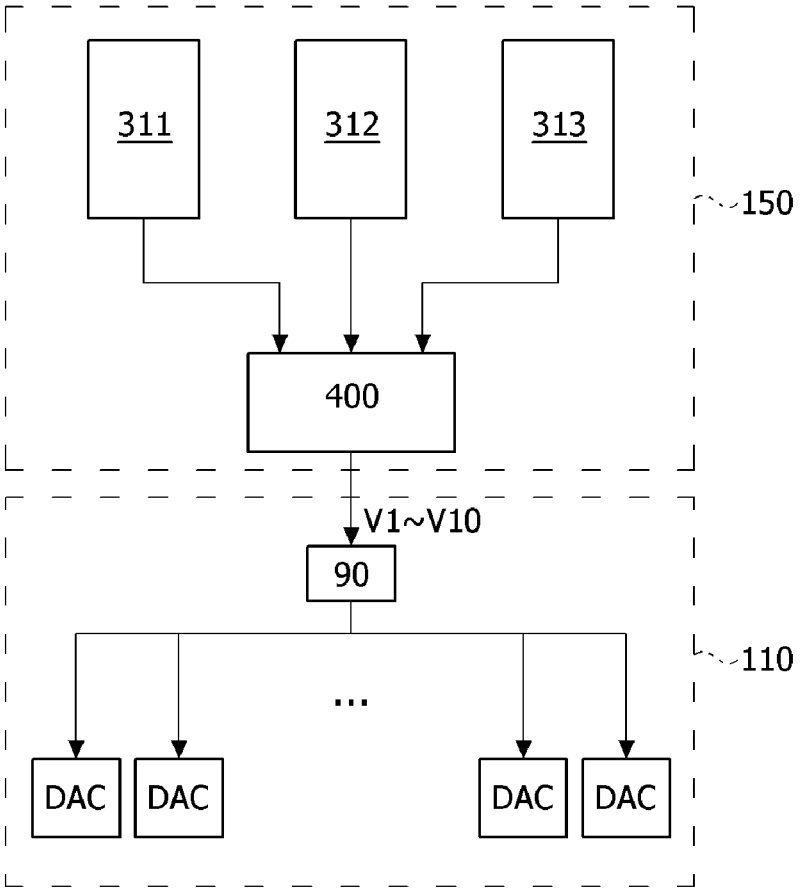
FIG. 16 is a block diagram illustrating a data driving device according to a first embodiment of the present disclosure.

FIG. 16 is a block diagram illustrating a data driving device according to a first embodiment of the present disclosure.

Referring to FIG. 16, the data driving device includes a gamma reference voltage generator 150 and a data driver 110.

The gamma reference voltage generator 150 includes first to third banks 311, 312, and 313 and a selector 400.

The banks 311, 312, and 313 separate and store digital setting data (hereinafter referred to as "gamma reference data") corresponding to a voltage level of the gamma reference voltage by colors. The first bank 311 provides first color gamma reference data to the selector 400. The second bank 312 provides second color gamma reference data to the selector 400. The third bank 313 provides third color gamma reference data to the selector 400.

The selector 400 is synchronized with a demultiplexer to sequentially select gamma reference data for each color, converts the selected gamma reference data into voltages to sequentially output gamma reference voltages V1 to V10 of first to third colors, and supplies the gamma reference voltages V1 to V10 to a common voltage divider circuit 90 of the data driver 110. The common voltage divider circuit 90 divides the gamma reference voltages V1 to V10 for the first to third colors, which are sequentially input from the selector 400, and supplies a gamma compensation voltage for each color to DACs. The common voltage divider circuit 90 may supply a first color gamma compensation voltage to the DACs, supply a second color gamma compensation voltage to the DACs, and then supply a third color gamma compensation voltage to the DACs.

The DACs may convert pixel data of the first color into the first color gamma compensation voltage and then may convert pixel data of the second color into the second color gamma compensation voltage to sequentially output data voltages of the first and second colors. Subsequently, the DACs may convert pixel data of the third color into a third color gamma compensation voltage to output a data voltage of the third color.

The demultiplexer may supply the data voltage of the first color, which is input from the DACs, to data lines connected to sub-pixels of the first color, supply the data voltage of the second color to data lines connected to sub-pixels of the second color and then supply the data voltage of the third color to data lines connected to sub-pixels of the third color.

Figure 17:
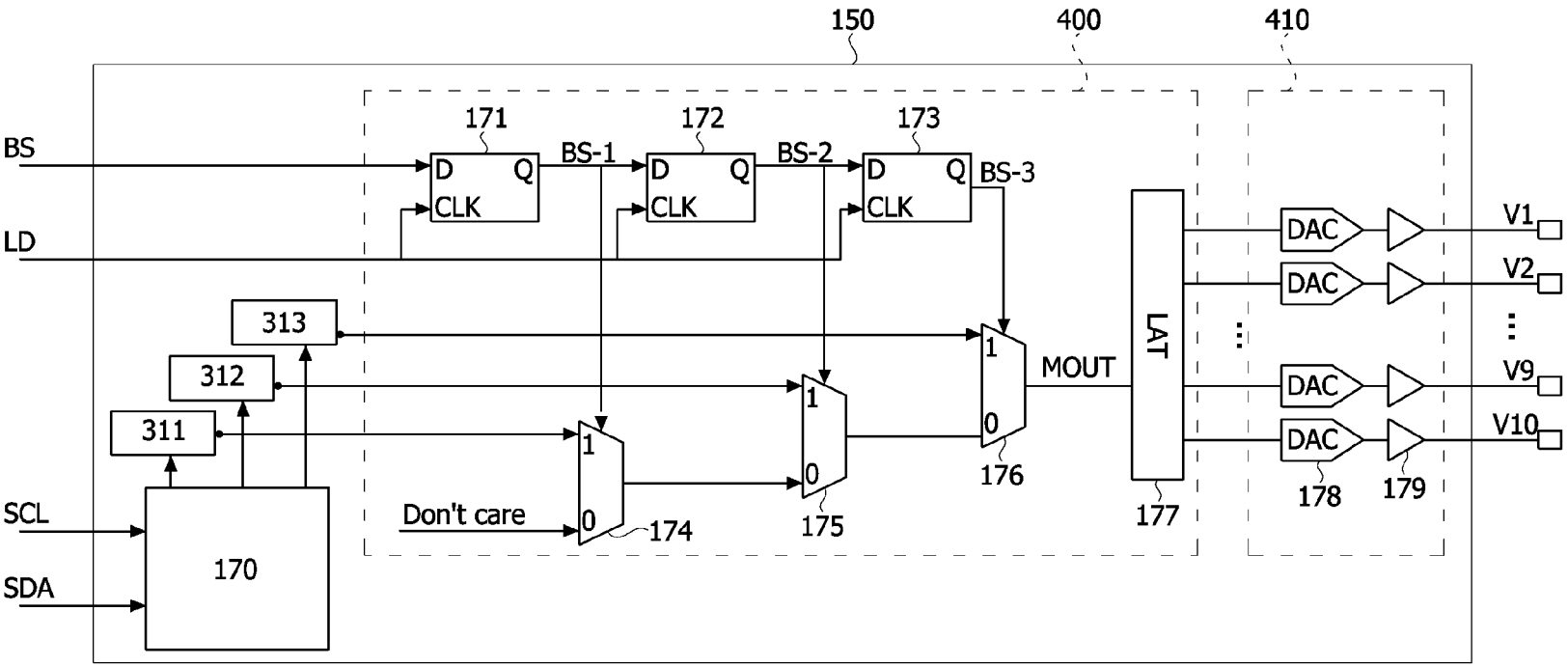
FIG. 17 is a detailed circuit diagram illustrating the data driving device shown in FIG. 16 according to the first embodiment of the present disclosure.
Figure 18:
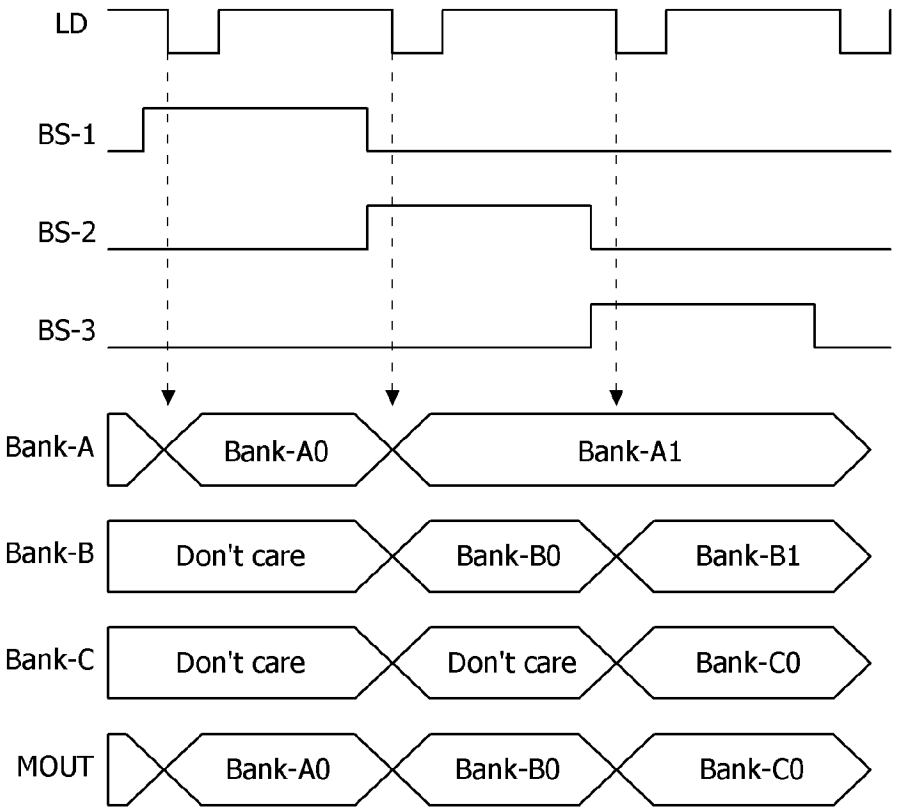
FIG. 18 is a waveform diagram illustrating input and output signals of a selector shown in FIG. 17 according to the first embodiment of the present disclosure.

FIG. 17 is a detailed circuit diagram illustrating the data driving device according to one embodiment. FIG. 18 is a waveform diagram illustrating input and output signals of a selector shown in FIG. 17 according to one embodiment.

Referring to FIGS. 17 and 18, the selector 400 includes first to third delays 171, 172, and 173, first to third multiplexers 174, 175 and 176, and a latch 177. The gamma reference voltage generator 150 further includes a voltage output part 410.

The first to third delays 171, 172, and 173 sequentially delay an enable signal BS. The enable signal BS may be generated to have a pulse width of approximately ⅓ of one horizontal period. The first delay 171 stores the enable signal BS from the TCON 130 and outputs the enable signal BS at a clock timing, thereby delaying the enable signal BS to output the firstly delayed enable signal BS-1. The second delay 172 stores the firstly delayed enable signal BS-1 and outputs the firstly delayed enable signal BS-1 at a clock timing, thereby delaying the firstly delayed enable signal BS-1 to output the secondarily delayed enable signal BS-2. The third delay 173 stores the secondarily delayed enable signal BS-2 and outputs the secondarily delayed enable signal BS-2 at a clock timing, thereby delaying the secondarily delayed enable signal BS-2 to output the thirdly delayed enable signal BS-3. Each of the delays 171, 172, and 173 may be implemented as a D flip-flop that outputs an input signal at a falling edge of a clock LD.

In response to the sequentially delayed enable signals BS-1, BS-2, and BS-2, the first to third multiplexers 174, 175, and 176 sequentially output the gamma reference data in order of the first color, the second color, and the third color.

When the firstly delayed enable signal BS-1 is a first logic value (high=1), the first multiplexer 174 selects gamma reference data Bank-A from the first bank 311 and outputs the gamma reference data Bank-A to the second multiplexer 175. The second multiplexer 175 receives an output signal of the second bank 312 and an output signal of the first multiplexer 174. When the secondarily delayed enable signal BS-2 is the first logic value (high=1), the second multiplexer 175 selects gamma reference data Bank-B from the second bank 312, whereas, when the secondarily delayed enable signal BS-2 is a second logic value (low=0), the second multiplexer 175 selects the gamma reference data Bank-A from the first multiplexer 174 and outputs the gamma reference data Bank-A to the third multiplexer 176. Accordingly, the second multiplexer 175 alternately selects first color reference data Bank-A and second color reference data Bank-B and provides the first color reference data Bank-A and the second color reference data Bank-B to the third multiplexer 176.

The third multiplexer 176 receives an output signal of the third bank 313 and an output signal of the second multiplexer 175. When the thirdly delayed enable signal BS-3 is the first logic value (high=1), the third multiplexer 176 selects gamma reference data Bank-C from the third bank 313, whereas, when the thirdly delayed enable signal BS-3 is the second logic value (low=0), the third multiplexer 176 selects the gamma reference data Bank-A and Bank-B from the second multiplexer 175 and outputs the gamma reference data Bank-A and Bank-B to the latch 177. Consequently, as can be seen from an output signal MOUT of FIG. 18, the third multiplexer 176 sequentially outputs the reference data in the order of the first color reference data Bank-A, the second color reference data Bank-B, and a third color reference data Bank-C. The latch 177 stores pieces of the gamma reference data sequentially input from the third multiplexer 176 and outputs the pieces of the gamma reference data at the same time.

The voltage output part 410 includes a plurality of DACs 178 and a plurality of buffers 179.

The DACs 178 convert gamma reference data D1 to D10 input from the latch 177 into gamma reference voltages. Voltage levels of the gamma reference voltages are determined according to digital values of the gamma reference data D1 to D10. Thus, since the gamma reference data is differently set for each color, the gamma reference voltage has a different voltage level for each color. Gamma reference voltages V1 to V10 output from the DACs 178 are supplied to the common voltage divider circuit 90 of the data driver 110 through the buffers 179. The latch 177 and the DACs 178 of the gamma reference voltage generator 150 are separate circuit components from the latch and the DACs of the data driver 110.

The gamma reference voltage generator 150 may further include a data inputter 170. The data inputter 170 may receive data through a standard communication interface, for example, an I2C interface, and update the gamma reference data for each color set in the banks 131, 132, and 133. The data inputter 170 may be implemented as an I2C interface logic. The TCON 130 may transmit the gamma reference data stored in the EEPROM 131 to the gamma reference voltage generator 150 through an I2C interface.

Figure 19:
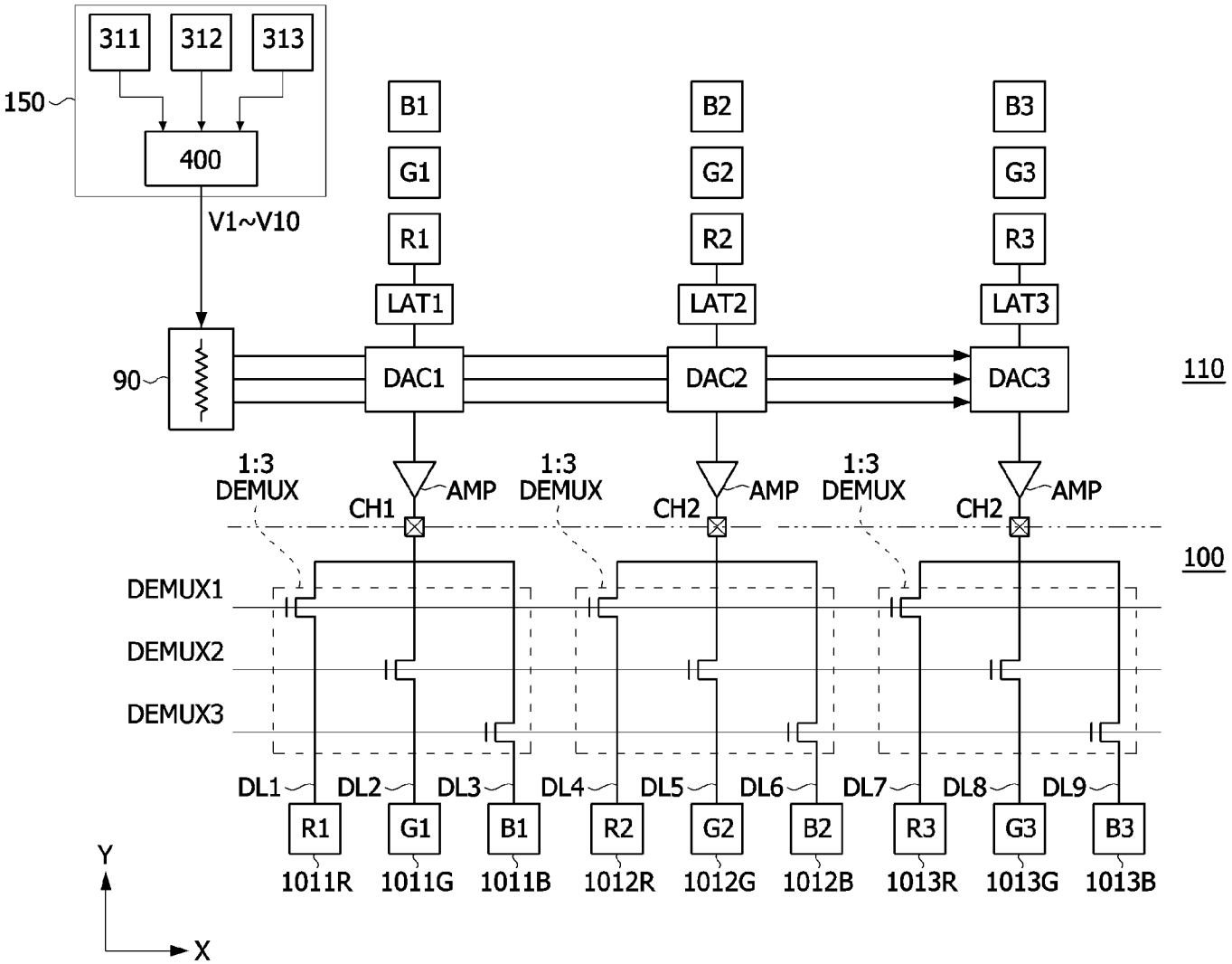
FIG. 19 is a circuit diagram illustrating a data driver and a demultiplexer to which the data driving device according to the first embodiment of the present disclosure is applied.

FIG. 19 is a circuit diagram illustrating a data driver and a demultiplexer to which the data driving device according to the first embodiment of the present disclosure is applied.

Referring to FIG. 19, a 1:3 demultiplexer 1:3 DEMUX may be connected to each channel CH1, CH2, or CH3 of the data driver 110. The data driver 110 includes latches LAT1, LAT2, and LAT3 and DACs DAC1, DAC2, and DAC3, which are disposed in the channels CH1, CH2, and CH3. The data driver 110 further includes the common voltage divider circuit 90.

The common voltage divider circuit 90 divides the gamma reference voltages V1 to V10, which are sequentially input from the gamma reference voltage generator 150 in the order of the first color R, the second color G, and the third color B, and supplies the gamma compensation voltage for each gradation of each color to the DACs DAC1, DAC2, and DAC3.

First color pixel data R1, R2, and R3, second color pixel data G1, G2, and G3, and third color pixel data B1, B2, and B3 may be sequentially input to the latches LAT1, LAT2, and LAT3 of the data driver 110.

The DACs DAC1, DAC2, and DAC3 convert the first color pixel data R1, R2, and R3 into the gamma compensation voltage of the first color output from the common voltage divider circuit 90 and output data voltages of the first color pixel data R1, R2, and R3. In response to a pulse of the first control signal DEMUX1, the 1:3 demultiplexers 1:3 DEMUX supply the data voltages of the first color pixel data R1, R2, and R3, which are input through an output buffers AMP, to the data lines DL1, DL4, and DL7 connected to the sub-pixels of the first color R.

Subsequently, the DACs DAC1, DAC2, and DAC3 convert the second color pixel data G1, G2, and G3 into the gamma compensation voltage of the second color G from the common voltage divider circuit 90 to output data voltages of the second color pixel data G1, G2, and G3. In response to a pulse of the second control signal DEMUX2, the 1:3 demultiplexers 1:3 DEMUX supply the data voltages of the second color pixel data G1, G2, and G3, which are input through the output buffers AMP, to the data lines DL2, DL5, and DL8 connected to the sub-pixels of the second color G.

Subsequently, the DACs DAC1, DAC2, and DAC3 convert the third color pixel data B1, B2, and B3 into the gamma compensation voltage of the third color B from the common voltage divider circuit 90 to output data voltages of the third color pixel data B1, B2, and B3. In response to a pulse of a third control signal DEMUX3, the 1:3 demultiplexers 1:3 DEMUX supply the data voltages of the third color pixel data B1, B2, and B3, which are input through the output buffers AMP, to the data lines DL3, DL6, and DL9 connected to the sub-pixels of the third color B.

Figure 20:
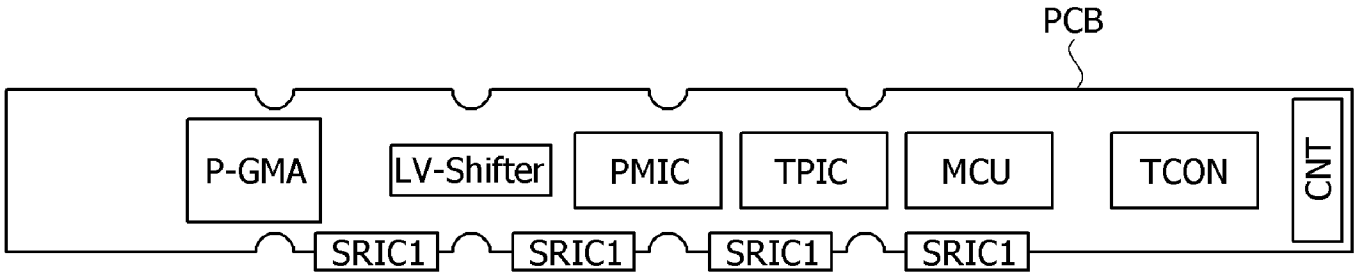
FIG. 20 is a diagram illustrating an example in which a programmable gamma integrated circuit (IC) is mounted on a small printed circuit board according to the first embodiment of the present disclosure.

As shown in FIG. 20, the gamma reference voltage generator 150 may be integrated into one P-GMA IC. Thus, according to the present disclosure, when the pixels are driven with an independent gamma compensation voltage for each color in the display device in which the demultiplexer array 112 is disposed on the display panel 100, and even when the PCB or the COF is small, the P-GMA IC may be mounted.

Figure 21:
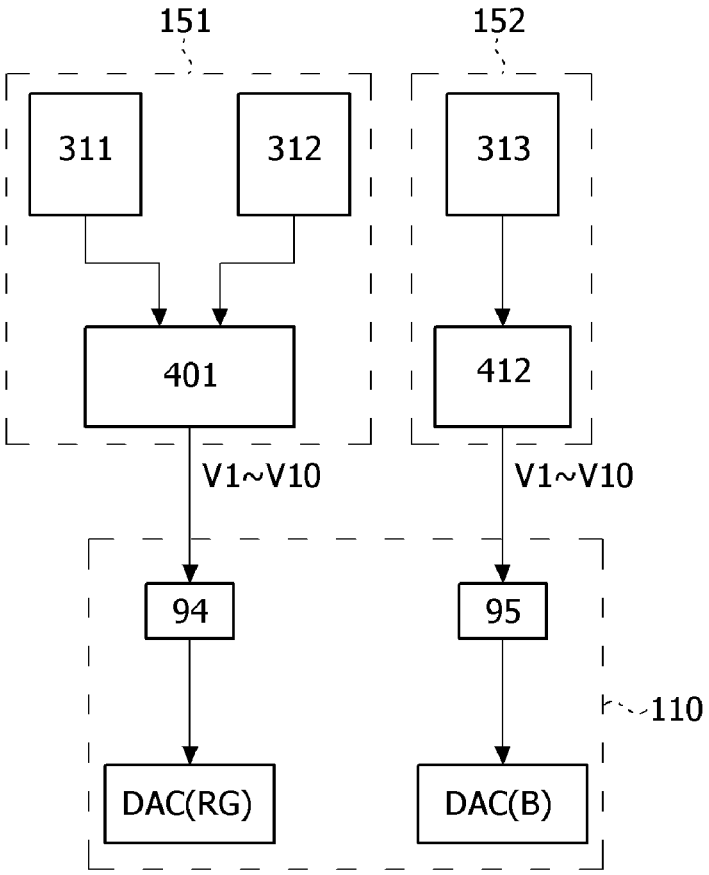
FIG. 21 is a block diagram illustrating a data driving device according to a second embodiment of the present disclosure.

FIG. 21 is a block diagram illustrating a data driving device according to a second embodiment of the present disclosure.

Referring to FIG. 21, a gamma reference voltage generator 150 includes a first gamma reference voltage generator 151 which alternately outputs a gamma reference voltage of a first color and a gamma reference voltage of a second color, and a second gamma reference voltage generator 152 which outputs a gamma reference voltage of a third color.

The first gamma reference voltage generator 151 includes first and second banks 311 and 312 and a selector 401.

The first and second banks 311 and 312 separate and store gamma reference data for each color. The first bank 311 provides first color gamma reference data to the selector 401. The second bank 312 provides second color gamma reference data to the selector 400.

The selector 401 is synchronized with a demultiplexer to alternately select the gamma reference data for each color, converts the selected gamma reference data into voltages to sequentially output gamma reference voltages V1 to V10 of the first to third colors, and supplies the gamma reference voltages V1 to V10 to a first voltage divider circuit 94 of a data driver 110. The first voltage divider circuit 94 divides the gamma reference voltages V1 to V10 for the first and second colors, which are sequentially input from the selector 401, and supplies a gamma compensation voltage for each color to a DAC DAC(RG). The first voltage divider circuit 94 may supply the gamma compensation voltage of the first color to the DAC DAC(RG) and then supply the gamma compensation voltage of the second color to the DAC DAC(RG).

The DAC DAC(RG) converts the pixel data of the first color into the gamma compensation voltage of the first color to output the data voltage of the first color and then converts the pixel data of the second color into the gamma compensation voltage of the second color to output the data voltage of the second color.

The demultiplexer may supply the data voltage of the first color input from the DAC DAC(RG) to data lines connected to the sub-pixels of the first color and then supply the data voltage of the second color to data lines connected to the sub-pixels of the second color.

The second gamma reference voltage generator 152 includes a third bank 313 and a voltage output part 412.

The third bank 313 stores third color gamma reference data. The voltage output part 412 converts the third color gamma reference data from the third bank 313 into a voltage, outputs gamma reference voltages V1 to V10 of the third color, and supplies the gamma reference voltages V1 to V10 to a second voltage divider circuit 95 of the data driver 110. The second voltage divider circuit 95 divides the gamma reference voltages V1 to V10 of the third color and supplies a gamma compensation voltage of the third color to a DAC DAC(B). The DAC DAC(B) converts pixel data of the third color into a gamma compensation voltage of the third color and outputs a data voltage of the third color.

The demultiplexer supplies the data voltage of the third color input from the DAC DAC(B) to data lines connected to the sub-pixels of the third color.

Figure 22:
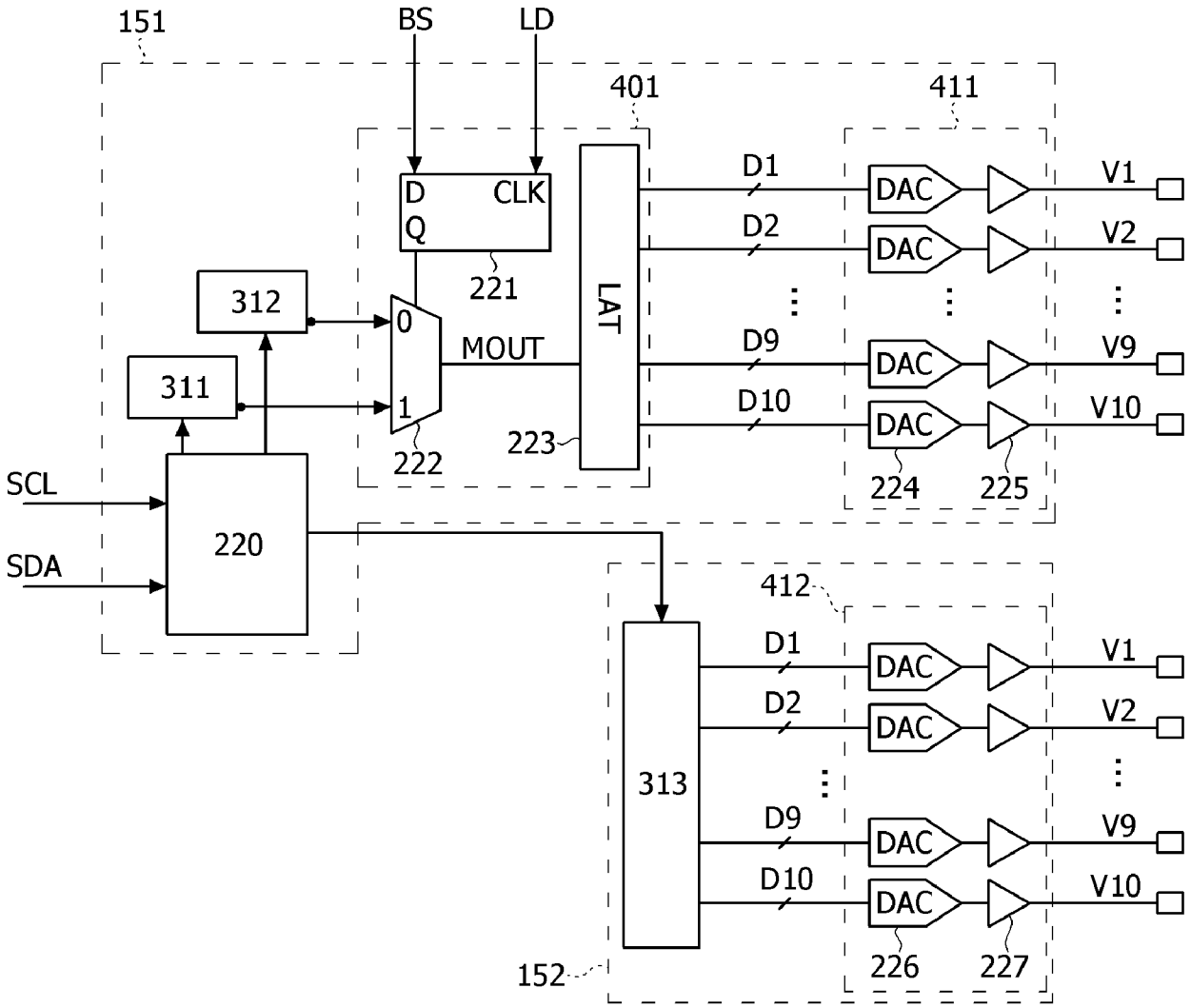
FIG. 22 is a detailed circuit diagram illustrating the data driving device shown in FIG. 21 according to the second embodiment of the present disclosure.
Figure 23:
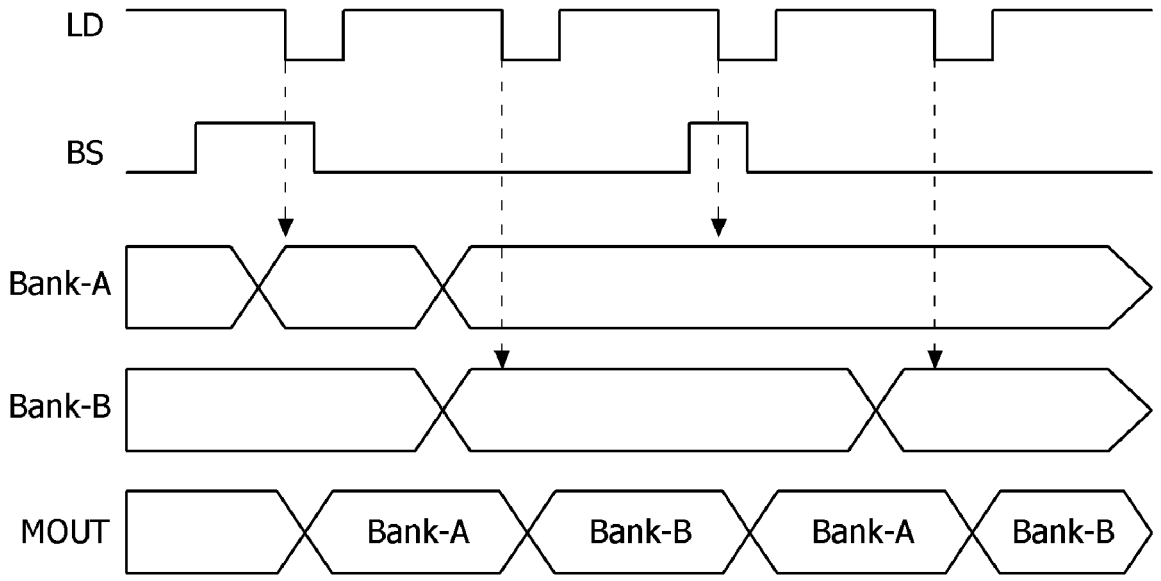
FIG. 23 is a waveform diagram illustrating input and output signals of a selector shown in FIG. 22 according to the second embodiment of the present disclosure.

FIG. 22 is a detailed circuit diagram illustrating the data driving device shown in FIG. 21 according to one embodiment. FIG. 23 is a waveform diagram illustrating input and output signals of a selector shown in FIG. 22 according to one embodiment.

Referring to FIGS. 22 and 23, the selector 401 of the first gamma reference voltage generator 151 includes the first and second banks 311 and 312, a delay 221, a multiplexer 222, and a latch 223. The first gamma reference voltage generator 151 includes a first voltage output part 411.

The delay 221 outputs the enable signal BS at a clock timing, thereby delaying the enable signal BS. The delay 221 may be implemented as a D flip-flop that outputs the enable signal BS at a falling edge of a clock LD.

In response to the enable signal BS, the multiplexer 222 alternately selects the first color gamma reference data and the second color gamma reference data. The multiplexer 222 receives an output signal of the first bank 311 and an output signal of the second bank 312. When the enable signal BS is a first logic value (high=1), the multiplexer 222 selects first color gamma reference data Bank-A input from the first bank 311. When the enable signal BS is a second logic value (low=0), the multiplexer 222 selects second color gamma reference data Bank-B input from the second bank 312 to supply the second color gamma reference data Bank-B to the latch 223. The latch 223 simultaneously stores and outputs the first color gamma reference data and the second color gamma reference data which are alternately input from the multiplexer 222.

The first voltage output part 411 includes a plurality of DACs 224 and a plurality of buffers 225.

The DACs 224 convert gamma reference data D1 to D10 input from latch 223 into gamma reference voltages. Voltage levels of the gamma reference voltages are determined according to digital values of the gamma reference data D1 to D10. Thus, since the gamma reference data is differently set for each color, the gamma reference voltage has a different voltage level for each color. The gamma reference voltages output from the DACs 224 are supplied to the first voltage divider circuit 94 of the data driver 110 through the buffers 225.

The first gamma reference voltage generator 151 may further include a data inputter 220. The data inputter 220 may update the gamma reference data for each color set in each of the banks 311, 312, and 313 with data received through an I2C interface.

The second gamma reference voltage generator 152 includes the third bank 313 and a second voltage output part 412. The second voltage output part 412 includes a plurality of DACs 226 and a plurality of buffers 227. The DACs 226 convert third color gamma reference data D1 to D10, which are input from the third bank 313, into gamma reference voltages. The gamma reference voltages output from the DACs 224 are supplied to the second voltage divider circuit 95 of the data driver 110 through the buffers 227.

Figure 24:
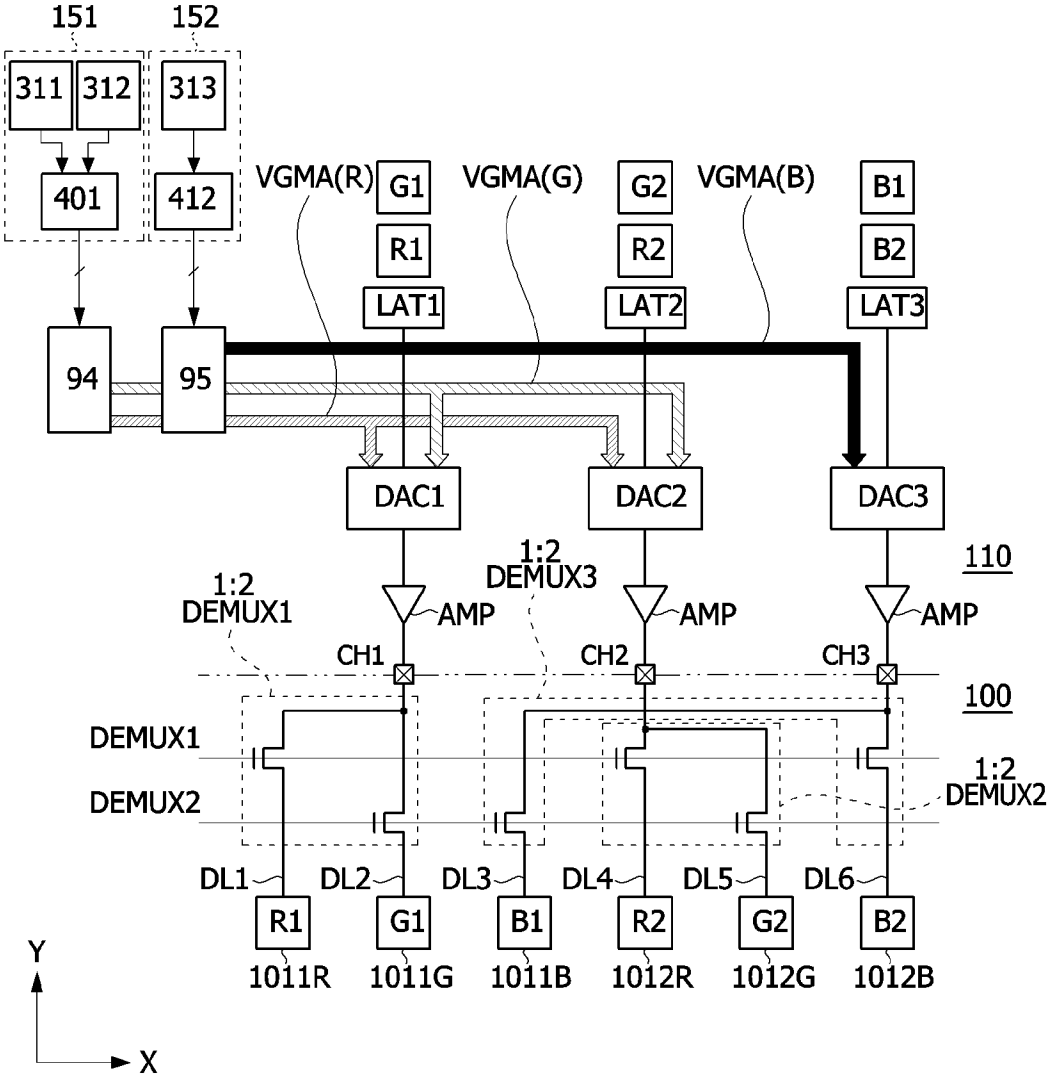
FIG. 24 is a circuit diagram illustrating a data driver and a demultiplexer to which the data driving device according to the second embodiment of the present disclosure is applied.
Figure 25:
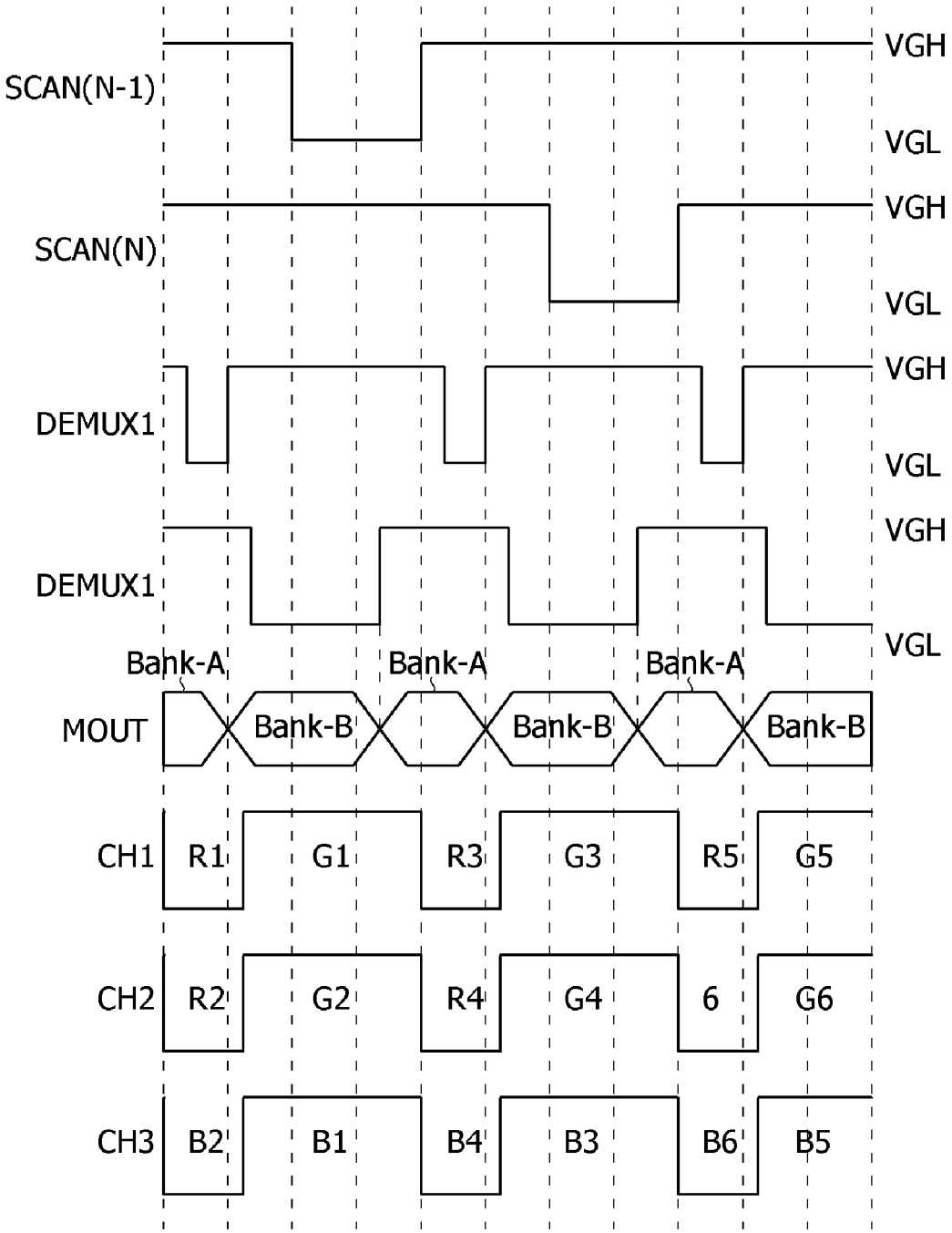
FIG. 25 is a waveform diagram illustrating gamma reference data output from a selector shown in FIG. 24, a scan signal, a control signal of a demultiplexer, and an output signal of the data driver according to an embodiment of the present disclosure.

FIG. 24 is a circuit diagram illustrating a data driver and a demultiplexer to which the data driving device according to the second embodiment of the present disclosure is applied. FIG. 25 is a waveform diagram illustrating gamma reference data Bank-A and Bank-B which are output from a selector shown in FIG. 24, scan signals SCAN(N−1) and SCAN(N), control signals DEMUX1 and DEMUX2 of a demultiplexer, and output signals R1 to B5 of the data driver 110.

Referring to FIG. 24, a 1:3 demultiplexer 1:2 DEMUX may be connected to each channel CH1, CH2, or CH3 of the data driver 110. The data driver 110 includes latches LAT1, LAT2, and LAT3 and DACs DAC1, DAC2, and DAC3, which are disposed in the channels CH1, CH2, and CH3. The data driver 110 further includes first and second voltage divider circuits 94 and 95.

The first voltage divider circuit 94 divides gamma reference voltages V1 to V10 of a first color R and gamma reference voltages V1 to V10 of a second color G, which are alternately input from the first gamma reference voltage generator 151, and supplies the gamma compensation voltages of the first color R and the second color G for each gradation to the first and second DACs DAC1 and DAC2. The second voltage divider circuit 95 divides gamma reference voltages V1 to V10 of a third color B input from the second gamma reference voltage generator 152 and supplies the gamma compensation voltage of the third color B for each gradation to the third DAC DAC3.

After first and third color pixel data R1, R2, and B2 are input to the latches LAT1 to LAT3 of the data driver 110, second and third color pixel data G1, G2, and B1 may be sequentially input to the latches LAT1 to LAT3.

During a first ½ horizontal period, the first DAC DAC1 converts the first color pixel data R1 from the first latch LAT1 into the gamma compensation voltage of the first color R input through the first voltage divider circuit 94, thereby outputting a data voltage of the first color pixel data RE Subsequently, during a second ½ horizontal period, the first DAC DAC1 converts the second color pixel data G1 from the first latch LAT1 into the gamma compensation voltage of the second color G input through the first voltage divider circuit 94, thereby outputting a data voltage of the second color pixel data G1 to an output buffer AMP of the first channel CH1.

During the first ½ horizontal period, the second DAC DAC2 converts the first color pixel data R2 from the second latch LAT2 into the gamma compensation voltage of the first color R input through the first voltage divider circuit 94, thereby outputting a data voltage of the first color pixel data R2. Subsequently, during the second 2/2 horizontal period, the second DAC DAC2 converts the second color pixel data G2 from the second latch LAT2 into the gamma compensation voltage of the second color G input through the first voltage divider circuit 94, thereby outputting a data voltage of the second color pixel data G2 to an output buffer AMP of the second channel CH2.

During the first ½ horizontal period, the third DAC DAC3 converts the third color pixel data B2 from the third latch LAT3 into the gamma compensation voltage of the third color B input through the second voltage divider circuit 95, thereby outputting a data voltage of the third color pixel data B2. Subsequently, during the second ½ horizontal period, the third DAC DAC3 converts the third color pixel data B1 from the third latch LAT3 into the gamma compensation voltage of the third color B input through the second voltage divider circuit 95, thereby outputting a data voltage of the third color pixel data B2 to an output buffer AMP of the third channel CH3.

Switching elements of demultiplexers 1:2 DEMUX1 to 1:2 DEMUX3 are turned on in response to pulses of control signals DEMUX1 and DEMUX2 which are generated as gate-on voltages VGH.

In response to the pulse of the first control signal DEMUX1, during the first ½ horizontal period, the first 1:2 demultiplexer 1:2 DEMUX1 supplies the data voltage of the first color pixel data R1, which is input through the output buffer AMP of the first channel CH1, to a first data line DL1 connected to sub-pixels of the first color R. Subsequently, in response to the pulse of the second control signal DEMUX2, during the second ½ horizontal period, the first 1:2 demultiplexer 1:2 DEMUX1 supplies the data voltage of the second color pixel data G1, which is input through the output buffer AMP of the first channel CH1, to a second data line DL2 connected to sub-pixels of the second color G.

In response to the pulse of the first control signal DEMUX1, during the first ½ horizontal period, the second 1:2 demultiplexer 1:2 DEMUX2 supplies the data voltage of the first color pixel data R2, which is input through the output buffer AMP of the second channel CH2, to a fourth data line DL4 connected to sub-pixels of the first color R. Subsequently, in response to the pulse of the second control signal DEMUX2, during the second ½ horizontal period, the second 1:2 demultiplexer 1:2 DEMUX2 supplies the data voltage of the second color pixel data G2, which is input through the output buffer AMP of the second channel CH2, to a fifth data line DL5 connected to sub-pixels of the second color G.

In response to the pulse of the first control signal DEMUX1, during the first ½ horizontal period, the third 1:2 demultiplexer 1:2 DEMUX3 supplies the data voltage of the third color pixel data B2, which is input through the output buffer AMP of the third channel CH3, to a sixth data line DL6 connected to sub-pixels of the third color B. Subsequently, in response to the pulse of the second control signal DEMUX2, during the second ½ horizontal period, the third 1:2 demultiplexer 1:2 DEMUX3 supplies the data voltage of the third color pixel data B1, which is input through the output buffer AMP of the third channel CH3, to a third data line DL3 connected to sub-pixels of the third color B.

Figure 26:
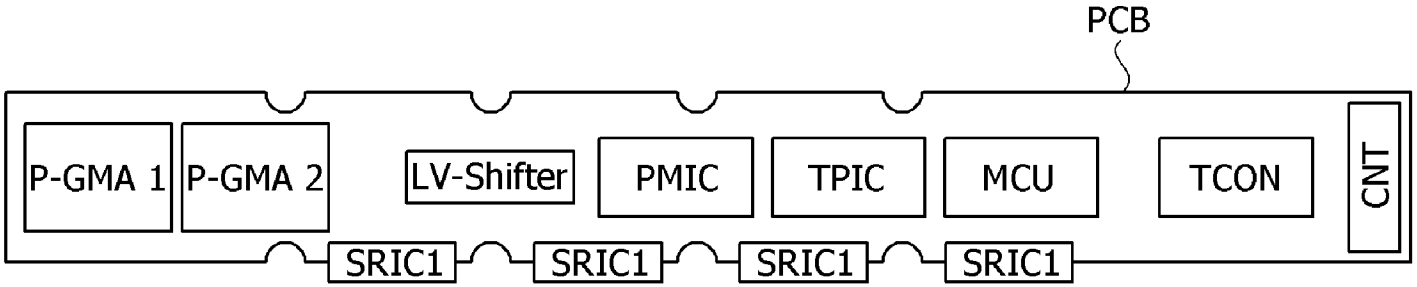
FIG. 26 is a diagram illustrating an example in which a programmable gamma IC is mounted on a small printed circuit board according to the second embodiment of the present disclosure.

As shown in FIG. 26, the first gamma reference voltage generator 151 may be integrated in a first programmable gamma IC P-GMA1. The second gamma reference voltage generator 152 may be integrated in a second programmable gamma IC P-GMA2.

In accordance with the present disclosure, since gamma reference voltages are sequentially selected for each color to be provided to a voltage divider circuit, and thus channels of a data driver are not separated for each color, a circuit configuration of the data driver can be simplified and a cost can be reduced.

In accordance with the present disclosure, since independent gamma compensation for each color can be implemented using one or two programmable gamma integrated circuits (ICs), it is not limited to a size of a printed circuit board (PCB) or a chip on film (COF) on which the programmable gamma ICs are mounted.

Effects which can be achieved by the present disclosure are not limited to the above-mentioned effects. That is, other objects that are not mentioned may be obviously understood by those skilled in the art to which the present disclosure pertains from the following description.

It will be apparent to those skilled in the art that various modifications can be made to the above-described exemplary embodiments of the present disclosure without departing from the spirit or scope of the disclosure. Thus, it is intended that the present disclosure covers all such modifications provided within the scope of the appended claims and their equivalents.

The objects to be achieved by the present disclosure, the means for achieving the objects, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A data driving device comprising:

a first bank that outputs gamma reference data of a first color;

a second bank that outputs gamma reference data of a second color;

a third bank that outputs gamma reference data of a third color;

a selector configured to sequentially select pieces of the gamma reference data from the first bank to the third bank in an order of the first color, the second color, and the third color;

a voltage output part configured to convert the pieces of the gamma reference data input from the selector into gamma reference voltages;

a voltage divider circuit configured to divide the gamma reference voltages for each color sequentially input from the voltage output part and output gamma compensation voltages for each color; and a plurality of digital-to-analog converters (DAC) configured to convert pixel data of the first color into the gamma compensation voltage of the first color, which is input from the voltage divider circuit, to output a data voltage of the first color, convert pixel data of the second color into the gamma compensation voltage of the second color, which is input from the voltage divider circuit, to output data voltage of the second color, and then convert pixel data of the third color into the gamma compensation voltage of the third color, which is input from the voltage divider circuit, to output a data voltage of the third color, wherein the selector includes:

a first delay, a second delay, and a third delay which sequentially delay an enable signal;

a first multiplexer configured to output the gamma reference data of the first color input from the first bank in response to a first logic value of the enable signal firstly delayed by the first delay;

a second multiplexer configured to output the gamma reference data of the second color input from the second bank in response to a first logic value of the enable signal secondarily delayed by the second delay and output the gamma reference data of the first color output from the first multiplexer in response to a second logic value of the secondarily delayed enable signal;

a third multiplexer configured to output the gamma reference data of the third color input from the third bank in response to a first logic value of the enable signal thirdly delayed by the third delay and output the gamma reference data of the first color or the third output from the second multiplexer in response to a second logic value of the thirdly delayed enable signal; and a latch configured to simultaneously store and output the gamma reference data input from the third multiplexer.

2. The data driving device of claim 1, wherein the voltage output part includes:

a plurality of DACs configured to convert the pieces of the gamma reference data input from the latch into the gamma reference voltages for each color; and a plurality of buffers configured to supply the gamma reference voltages for each color input from the DACs to the voltage divider circuit.

3. A data driving device comprising:

a first gamma reference voltage generator that includes a first bank that outputs gamma reference data of a first color, a second bank that outputs gamma reference data of a second color, and a selector configured to alternately select and convert pieces of the gamma reference data of the first color and the second color into gamma reference voltages to alternately output the gamma reference voltages for each color;

a second gamma reference voltage generator which includes a third bank that outputs gamma reference data of a third color and converts the gamma reference data of the third color into a gamma reference voltage to output the gamma reference voltage of the third color;

a first voltage divider circuit configured to divide the gamma reference voltages of the first color and the second color input from the first gamma reference voltage generator to alternately output the gamma compensation voltages of the first color and the second color;

a second voltage divider circuit configured to divide the gamma reference voltage of the third color input from the second gamma reference voltage generator to alternately output the gamma compensation voltage of the third color;

a first digital-to-analog converter (DAC) configured to convert pixel data of the first color into a gamma compensation voltage of the first color input from the first voltage divider circuit to output a data voltage of the first color and configured to convert pixel data of the second color into a gamma compensation voltage of the second color input from the first voltage divider circuit to output a data voltage of the second color; and a second digital-to-analog converter (DAC) configured to convert pixel data of the third color into a gamma compensation voltage of the third color input from the second voltage divider circuit to output a data voltage of the third color.

4. The data driving device of claim 3, wherein the selector includes:

a delay configured to delay an enable signal;

a multiplexer configured to output the gamma reference data of the second color input from the first bank in response to a first logic value of the enable signal delayed by the delay and output the gamma reference data of the second color input from the second bank in response to a second logic value of the delayed enable signal; and a latch configured to simultaneously store and output the gamma reference data input from the multiplexer.

5. The data driving device of claim 4, wherein the first gamma reference voltage generator includes:

a plurality of digital-to-analog converters configured to convert the pieces of the gamma reference data input from the latch into gamma reference voltages to output the gamma reference voltages; and a plurality of buffers configured to supply the gamma reference voltages input from the digital-to-analog converters to the voltage divider circuit.

6. A display device comprising:

a display panel in which data lines connected to sub-pixels of a first color, data lines connected to sub-pixels of a second color, data lines connected to sub-pixels of a third color, and a plurality of demultiplexers configured to distribute an input data voltage to the data lines are disposed;

a programmable gamma integrated circuit (IC) configured to sequentially select and convert a gamma reference voltage of the first color, a gamma reference voltage of the second color, and a gamma reference voltage of the third color for each color into voltages to output gamma reference voltages for each color; and a data driver including a voltage divider circuit configured to divide the gamma reference voltages for each color input from the programmable gamma IC and output gamma compensation voltages for each color, a plurality of digital-to-analog converters configured to convert pixel data into data voltages as the gamma compensation voltages for each color, and buffers configured to output the data voltages to the demultiplexers, wherein the programmable gamma IC includes:

a first bank that outputs gamma reference data of the first color;

a second bank that outputs gamma reference data of the second color;

a third bank that outputs gamma reference data of the third color;

a selector configured to sequentially select pieces of the gamma reference data input from the first bank to the third bank in an order of the first color, the second color, and the third color; and a voltage output part configured to convert the pieces of the gamma reference data input from the selector into the gamma reference voltages and outputs the gamma reference voltages for each color, wherein the selector includes:

a first delay, a second delay, and a third delay which sequentially delay an enable signal;

a first multiplexer configured to output the gamma reference data of the first color input from the first bank in response to a first logic value of the enable signal firstly delayed by the first delay;

a second multiplexer configured to output the gamma reference data of the second color input from the second bank in response to a first logic value of the enable signal secondarily delayed by the second delay and output the gamma reference data of the first color output from the first multiplexer in response to a second logic value of the secondarily delayed enable signal;

a third multiplexer configured to output the gamma reference data of the third color input from the third bank in response to a first logic value of the enable signal thirdly delayed by the third delay and output the gamma reference data of the first color or the third output from the second multiplexer in response to a second logic value of the thirdly delayed enable signal; and a latch configured to simultaneously store and output the gamma reference data input from the third multiplexer.

7. The data driving device of claim 6, wherein the voltage output part includes:

a plurality of digital-to-analog converters configured to convert the pieces of the gamma reference data input from the latch into the gamma reference voltages for each color; and a plurality of buffers configured to supply the gamma reference voltages from the digital-to-analog converters to the voltage divider circuit.

8. The data driving device of claim 6, wherein each of the plurality of demultiplexers supplies, using a 1:3 demultiplexer, the data voltage of the first color input from the data driver to the data lines connected to the sub-pixels of the first color in response to a first control signal, supplies the data voltage of the second color input from the data driver to the data lines connected to the sub-pixels of the second color in response to a second control signal, and supplies the data voltage of the third color input from the data driver to the data lines connected to the sub-pixels of the third color in response to a third control signal.

9. A display device comprising:

a display panel in which data lines connected to sub-pixels of a first color, data lines connected to sub-pixels of a second color, data lines connected to sub-pixels of a third color, and a plurality of demultiplexers configured to distribute an input data voltage to the data lines are disposed;

a first programmable gamma integrated circuit (IC) configured to alternately select and convert a gamma reference voltage of the first color and a gamma reference voltage of the second color into voltages to output gamma reference voltages of the first color and the second color;

a second programmable gamma IC configured to convert a gamma reference voltage of the third color into a voltage to output a gamma reference voltage of the third color; and a data driver including a voltage divider circuit configured to divide the gamma reference voltages for each color input from the first programmable gamma IC and the second programmable gamma IC and output gamma compensation voltages for each color, a plurality of digital-to-analog converters (DACs) configured to convert pixel data into data voltages as the gamma compensation voltages for each color, and buffers configured to output the data voltages to demultiplexers, wherein the first programmable gamma IC includes:

a first bank which outputs gamma reference data of the first color;

a second bank which outputs gamma reference data of the second color; and a selector configured to alternately select and convert pieces of the gamma reference data of the first color and the second color into the gamma reference voltages and alternately output the gamma reference voltages of the first color and the second color.

10. The display device of claim 9, wherein the voltage divider circuit includes:

a first voltage divider circuit configured to divide the gamma reference voltages of the first color and the second color input from the first programmable gamma IC to alternately output the gamma compensation voltages of the first color and the second color; and a second voltage divider circuit configured to divide the gamma reference voltage of the third color input from the second programmable gamma IC to alternately output the gamma compensation voltage of the third color, and the digital-to-analog converters include:

a first digital-to-analog converter (DAC) configured to convert the pixel data of the first color into the gamma compensation voltage of the first color input from the first voltage divider circuit to output the data voltage of the first color and configured to convert the pixel data of the second color into the gamma compensation voltage of the second color input from the first voltage divider circuit to output the data voltage of the second color; and a second digital-to-analog converter (DAC) configured to convert the pixel data of the third color into the gamma compensation voltage of the third color input from the second voltage divider circuit to output the data voltage of the third color.

11. The display device of claim 10, wherein the selector includes:

a delay configured to delay an enable signal;

a multiplexer configured to output the gamma reference data of the second color input from the first bank in response to a first logic value of the enable signal delayed by the delay and output the gamma reference data of the second color input from the second bank in response to a second logic value of the delayed enable signal; and a latch configured to simultaneously store and output the gamma reference data input from the multiplexer.

12. The display device of claim 11, wherein the first programmable gamma IC includes:

a plurality of digital-to-analog converters configured to convert pieces of the gamma reference data input from the latch into the gamma reference voltages of the first color and the second color; and a plurality of buffers configured to supply the gamma reference voltages of the first color and the second color input from the plurality of digital-to-analog converters to the first voltage divider circuit.

13. The display device of claim 10, wherein the second programmable gamma IC includes:

a plurality of digital-to-analog converters configured to convert the gamma reference data input from the third bank into the gamma reference voltage of the third color; and a plurality of buffers configured to supply the gamma reference voltage of the third color input from the digital-to-analog converters to the second voltage divider circuit.

14. The display device of claim 9, wherein the plurality of demultiplexers include:

a first 1:3 demultiplexer configured to supply the data voltage of the first color input from a first channel of the data driver to a first data line connected to the sub-pixels of the first color in response to a first control signal and then supply the data voltage of the second color input from the first channel of the data driver to a second data line connected to the sub-pixels of the second color in response to a second control signal;

a second 1:3 demultiplexer configured to supply the data voltage of the first color input from a second channel of the data driver to a fourth data line connected to the sub-pixels of the first color in response to the first control signal and then supply the data voltage of the second color input from the second channel of the data driver to a fifth data line connected to the sub-pixels of the second color in response to the second control signal; and a third 1:3 demultiplexer configured to supply the data voltage of the third color input from a third channel of the data driver to a sixth data line connected to the sub-pixels of the third color in response to the first control signal and then supply the data voltage of the third color input from the third channel of the data driver to a third data line connected to the sub-pixels of the third color in response to the second control signal.

* * * * *